US008425387B1

(12) United States Patent
Christensen et al.

(10) Patent No.: US 8,425,387 B1
(45) Date of Patent: Apr. 23, 2013

(54) METHOD FOR MANUFACTURING STAIR STEP PORTFOLIO FILE

(75) Inventors: Duane Christensen, Hastings, MN (US); Tim Blegen, Spring Valley, WI (US); Dennis Bowen, Ellsworth, WI (US); Harold Peter Lindelof, Eden Prairie, MN (US)

(73) Assignee: Smead Manufacturing Company, Hastings, MN (US)

( * ) Notice: Subject to any disclaimer, the term of this patent is extended or adjusted under 35 U.S.C. 154(b) by 309 days.

(21) Appl. No.: 12/916,839

(22) Filed: Nov. 1, 2010

Related U.S. Application Data

(60) Provisional application No. 61/307,917, filed on Feb. 25, 2010.

(51) Int. Cl.
*B31B 49/00* (2006.01)
*B65D 27/00* (2006.01)

(52) U.S. Cl.
USPC ..... 493/186; 493/238; 493/267; 493/918; 229/67.1; 229/72; 206/425

(58) Field of Classification Search ..... 493/186, 493/238, 267, 918, 920; 229/67.1, 67.2, 229/67.3, 67.4, 72; 206/425
See application file for complete search history.

(56) References Cited

U.S. PATENT DOCUMENTS

| | | | | | |
|---|---|---|---|---|---|
| 923,539 | A * | 6/1909 | Law | 229/72 |
| 1,572,239 | A * | 2/1926 | Low | 229/67.1 |
| 1,600,999 | A * | 9/1926 | Sea | 206/425 |
| 4,331,290 | A * | 5/1982 | Benham | 229/72 |
| 4,444,314 | A * | 4/1984 | Jacobsson | 206/425 |
| 4,540,390 | A * | 9/1985 | Thorschmidt | 493/23 |
| 4,669,651 | A * | 6/1987 | Shaw et al. | 229/67.3 |
| 4,730,727 | A * | 3/1988 | Petroff | 206/311 |
| 6,273,470 | B1 * | 8/2001 | Bullock | 281/29 |
| 6,938,549 | B2 * | 9/2005 | Bullock | 101/483 |
| 2006/0113206 | A1 * | 6/2006 | Warner | 206/425 |
| 2007/0235506 | A1 * | 10/2007 | Shapiro | 229/67.3 |
| 2008/0197175 | A1 * | 8/2008 | Christensen et al. | 229/67.1 |
| 2011/0290866 | A1 * | 12/2011 | Dodson et al. | 229/67.2 |

* cited by examiner

*Primary Examiner* — Hemant M Desai
(74) *Attorney, Agent, or Firm* — Altera Law Group, LLC

(57) ABSTRACT

A stair-step, expandable file folder is disclosed, in which each pocket in the folder has the same depth, rather than the back pockets being deeper than the front pockets. The folder is formed from a group of attached dividers. Each divider in the group is generally planar and includes two horizontal folds near a bottom edge of the divider. The divider area above the folds forms a wall of a pocket. The divider area between the folds extends to an adjacent divider and forms the bottom of the pocket. The divider area below the folds is attached to the adjacent divider. The adjacent divider forms an opposing wall of the pocket. When the group of dividers is compressed front-to-back, the dividers all have the same lateral footprint. When the group is expanded front-to-back, the dividers translate vertically, so that the tops of the dividers are all visible simultaneously from the front of the folder. During manufacturing, the group of dividers may be tilted front-to-back to ensure that the bottoms of the pockets remain in contact with their respective tooling elements.

10 Claims, 21 Drawing Sheets

METHOD FOR MANUFACTURING STAIR STEP PORTFOLIO FILE

CROSS-REFERENCE TO RELATED APPLICATION

This application claims the benefit of U.S. Provisional Application No. 61/307,917 filed 25 Feb. 2010, which hereby are incorporated herein by reference in its entirety.

BACKGROUND OF THE INVENTION

1. Field of the Invention

The present invention is directed to file folders, and more particularly to stair-step style expandable file folders.

2. Description of the Related Art

File folders are common in home and office settings.

A typical expandable file folder includes a series of rectangular dividers that are joined on three sides to respective pleats in an expandable gusset. The folder has pockets formed between each adjacent pair of dividers. Each pocket is accessible from the unbound edge of the dividers, which will be referred to in this document as the top edge of the file folder.

One common type of expandable file folder is referred to as a stair-step expandable folder. In a stair-step expandable folder, the dividers extend by different amounts along the top edge of the folder. The dividers at the back of the folder extend upward farther than those at the front of the folder, so that the top edges of all the dividers are viewable simultaneously. A user can select a desired pocket directly, rather than having to flip through all the dividers to find the correct pocket.

One potential drawback to typical stair-step expandable folders is that the pockets have different depths. Because the dividers at the rear of the folder extend farther upward than those at the front of the folder, the pockets at the rear of the folder are deeper than those at the front of the folder. As a result, documents stored in a rear pocket are more difficult to access than those stored in a front pocket. This difficulty in accessing the rear pockets is unacceptable.

Accordingly, there exists a need for a stair-step expandable file folder in which the stored documents are easily accessible for all pockets, and a suitable method for manufacturing such a folder.

BRIEF SUMMARY OF THE INVENTION

An embodiment is a stair-step file folder having top-accessible pockets, comprising: a plurality of dividers defining the pockets therebetween; the dividers in the plurality increasing in height from a front face of the folder to a back face of the folder; each divider having a fold portion that horizontally extends to an adjacent divider and forms a bottom of a respective pocket; the separation between the fold portion and a top edge of the divider being equal for all dividers in the plurality.

Another embodiment is a method for maintaining equal pocket depths in an expandable stair-step file folder, comprising: providing a plurality of dividers defining pockets therebetween, the dividers increasing in height from the front to the back of the folder; and folding each divider to form a bottom for each respective pocket, the folds increasing in height from the front to the back of the folder.

A further embodiment is a rectangular file folder, comprising: an expandable gusset forming a bottom edge and two side edges of the folder; and a plurality of dividers extending laterally across the folder and oriented parallel to a front face and a back face of the folder. Each pair of adjacent dividers defines a pocket therebetween. Each divider joins the gusset at a respective fold in the gusset along the side edges of the folder. Along a top edge of the folder, each divider in the plurality extends farther upward than all other dividers between said divider and the front face of the folder. Each divider includes at least one laterally-oriented fold that forms a bottom edge of a respective pocket. The respective folds in the dividers are all at different distances from the bottom edge of the folder. The respective folds in the dividers are all at equal distances from top edges of the respective dividers.

An additional embodiment is an expandable stair-step file folder, comprising: an expandable gusset forming a bottom edge and two side edges of the folder, the gusset including repeating folds that form a series of regularly-spaced troughs parallel to a front face and a back face of the folder, the troughs extending continuously along the bottom edge and the two side edges of the folder; and a plurality of dividers within the troughs, each divider including: a top portion parallel to the front face of the folder, the top portion extending laterally between the two side edges of the folder and extending vertically down to a top fold line, the top fold line being parallel to the bottom edge of the folder; an intermediate portion extending toward the front face of the folder from the top fold line to a bottom fold line, the intermediate portion extending generally horizontally between a pair of adjacent troughs, the bottom fold line being parallel to the bottom edge of the folder; and a bottom portion parallel to the front face of the folder, the bottom portion extending vertically from the bottom fold line to the bottom edge of the folder and extending laterally between the two side edges of the folder. The top and bottom portions each extend into adjacent troughs. The intermediate portions of the dividers are all at different heights.

A further additional embodiment is a method of producing an expandable stair-step file folder, comprising: providing an expandable gusset along a bottom edge and two side edges of the folder, the gusset including repeating folds that form a series of regularly-spaced troughs parallel to a front face and a back face of the folder, the troughs extending along the bottom edge and the two side edges of the folder; and for each trough: providing a generally rectangular sheet having top, bottom and side edges; folding the sheet a first time to form a first fold line parallel to the top and bottom edges of the sheet; folding the sheet a second time to form a second fold line adjacent to and parallel to the first fold line and disposed between the first fold line and the bottom edge of the sheet; reducing the width of the sheet between the first and second fold lines; inserting into the trough a portion of the sheet from the bottom edge of the sheet to the second fold line; extending generally horizontally a portion of the sheet between the first and second fold lines; and inserting into an adjacent trough a portion of the sheet from the first fold line to the top edge of the sheet.

According to a further embodiment there is disclosed a stair step file folder having a plurality of top-accessible pockets, having a plurality of dividers defining the pockets therebetween; a web formed to provide a bottom and two sidewalls of the folder a plurality of dividers of successively increasing height from a front face of the folder to a back face of the folder, said dividers being affixed to said web at the bottom thereof; each divider having an upper generally planar portion lying with in a first plane, a fold portion, constituting a floor, that extends generally orthogonally from said plane and away from the upper planar portion and a lower generally planar portion extending generally orthogonally from said fold portion and residing in a second plane parallel and offset from said first plane, the plurality of divider being spaced apart generally equal to an offset created by the fold portion.

The plurality of dividers being joined such that the floor is bounded by planar portions of successive dividers. The location of the fold portion on each divider being successively higher from front to back, so that the floor of each pocket is likewise successively higher and each divider may be formed of a continuous web material.

DETAILED DESCRIPTION OF THE INVENTION

A stair-step, expandable file folder is disclosed, in which each pocket in the folder has a predeterminable depth, preferably the same depth, rather than the back pockets being automatically deeper than the front pockets. The folder includes a series of dividers that form the front and back sides of the pockets of the folder. The dividers have predetermined height, usually increasing height, from the front to the back of the folder. It is however possible to utilize this invention to have pockets of different depth depending upon need. For example, it is possible that some pockets could be suitable for A-4 or Letter size depth in landscape (horizontal) orientation while others could be in letter (vertical) orientation. Likewise, other paper formats could be accommodated by setting different predetermined depths for different pockets.

The dividers are folded to form the bottoms of the pockets, with the folded portions also increasing in height from the front to the back of the folder. Each divider extends downward to form the back face of a pocket, is folded forward to form the bottom face of the pocket, and is folded downward to extend to the bottom edge of the folder. The troughs in an expandable gusset support the bottom and the sides of the dividers. Above the fold portion, the divider laterally extends into one trough. Below the fold portion, the divider laterally extends into the adjacent trough toward the front of the folder. In the preferred embodiment and to facilitate efficient manufacture and conservation of materials, the dividers are unitary, i.e. made of a single sheet or continuous web without joints, but merely with folds.

The preceding paragraphs are merely a summary, and should not be construed as limiting in any way. A more detailed description follows, first of the folder itself in FIGS. 1-11 and the accompanying text, then of the method of manufacturing such a folder.

Figure 1A:
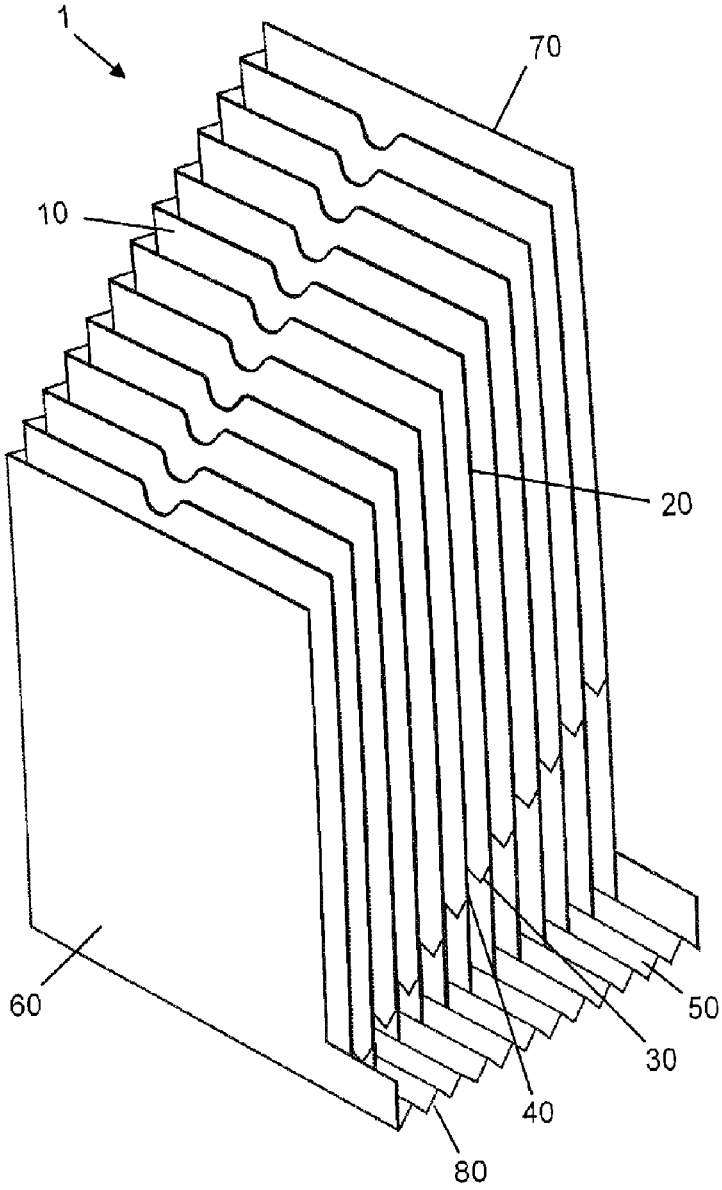
FIG. 1A is a cutaway drawing of the interior of an expandable stair-step folder.

FIG. 1A is a cutaway drawing of the interior of an expandable stair-step folder 1. The folder 1 has a series of laterally-extending pockets that are generally parallel to the front face 60 and the back face 70 of the folder 1. Documents may be inserted and removed from the top edges of the pockets. The pockets themselves are formed by a series of dividers 10. The dividers are supported on their side by an expandable gusset 50 that surrounds them on the bottom 80 and left and right sides of the folder 1. The gussets can be a web material which provides lightness and airflow, or solid.

In contrast with many known expandable folders, in which the pocket depth increases from the front to the back of the folder, the folder 1 has a uniform pocket depth from the front 60 to the back 70 of the folder 1. Rather than using the expandable gusset 50 at the bottom 80 of the folder to form the bottom of the pockets, the dividers 10 themselves are folded, with the folded portion 30 of the dividers 10 forming the bottom of the pockets. The folded portions 30 increase in height from the front 60 to the back 70 of the folder 1, maintaining a generally uniform distance from the top edges of the dividers, so that the pocket depth is generally the same for all pockets.

The front 60 and/or rear 70 faces of the folder may be optionally constructed differently than the dividers 10, so that the front and/or rear pockets in the folder 1 may be different in construction than the interior pockets.

Figure 1B:
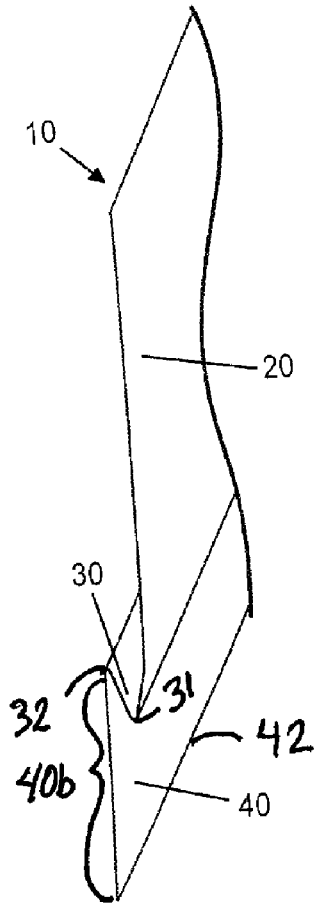
FIG. 1B is a cutaway drawing of one divider, viewed from the right/rear sides.

FIG. 1B is a cutaway drawing of one divider 10 from the folder 1, viewed from the right/rear sides. The divider 10 includes a top portion 20 that may extend laterally (horizontally) across the entire folder, and may extend vertically from a top edge down to a fold portion 30. The top portions 20 of all the dividers 10 form the front and back sides of the pockets. The fold portions 30 of all the dividers 10 form the bottoms of the pockets. The divider 10 may be further folded to have a bottom portion 40, adjacent to the fold portion 30 on the side opposite the top portion 20. The bottom portion 40 may optionally extend vertically from the fold portion 30 to a trough in the expandable gusset 50. The bottom portion may also optionally extend laterally across the entire folder 1, although it may alternatively be narrower than the troughs in the gusset 50.

In this way a zig-zag fold consisting of portions 20, 30 and 40 is formed. The location of folds 31 and 32 determines the floor/bottom of the pocket. Fold 31 actually sets the "floor" and the length of material between folds 31 and 32 sets the width of the pocket. The length from fold 32 to the bottom edge 42 of the divider 10 sets the height of the floor from the true bottom of the folder.

In some cases, the top portions 20 of all the dividers are generally the same height, the fold portions 30 are all generally the same size, the bottom portions 40 are all generally the same width and increase in height from the front 60 to the back 70 of the folder 1.

Figure 2:
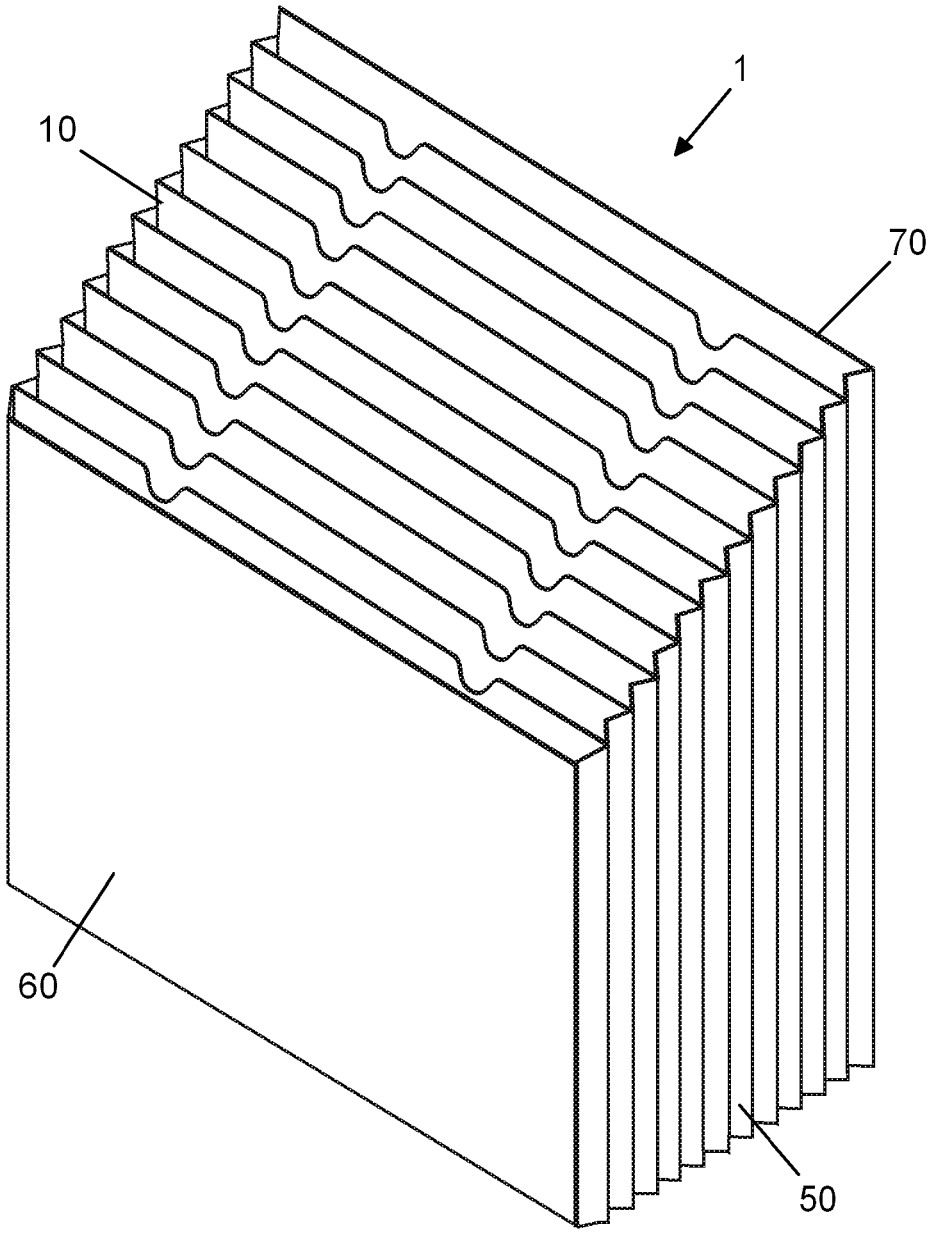
FIG. 2 is a plan drawing of an assembled stair-step folder.

FIG. 2 is a plan drawing of an assembled stair-step folder 1. When assembled, the fold portions 30 are blocked from view by the gusset 50, except from directly above the folder 1.

Figure 3A:
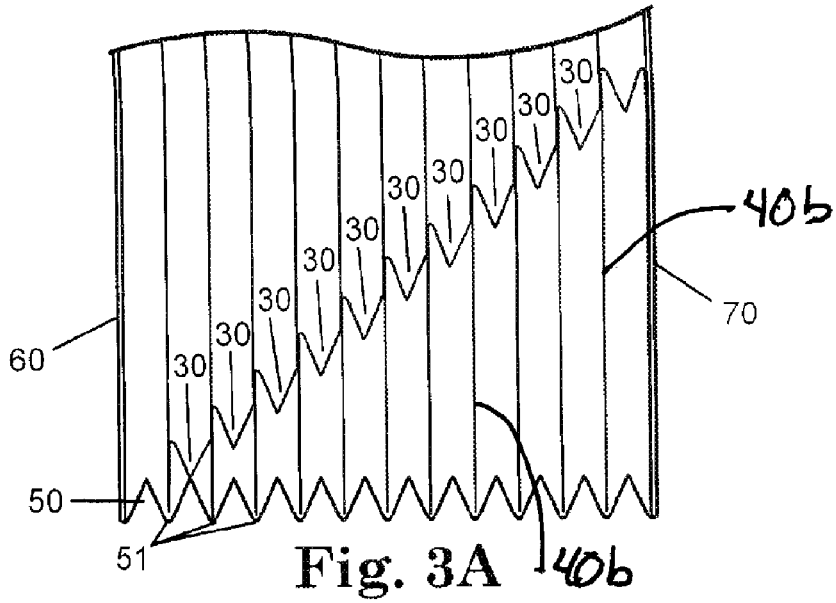
FIG. 3A is a close-up view of the folded portions and the expandable gusset at the bottom of the folder.

FIG. 3A is a close-up view of the folded portions 30 and the expandable gusset 50 at the bottom of the folder. The folded portions 30 increase in height from the front 60 to the back 70 of the folder, so that the pocket depth remains roughly constant for all the interior pockets in the folder. Notice that height 40*b* is increasing, but the depth of each pocket is uniform. As mentioned above, the height 40*b* can vary according to a user's needs, so that some pockets can be deeper or shallower as desired.

It is also possible that fold 31 (FIG. 1B) could be perforated or have any number of other "break away" (i.e., be knocked out along its entire length) connections so that the bottom would become floor 51 (FIG. 3A). This would allow a user to selectively create a special deeper pocket "on the fly".

Figure 3B:
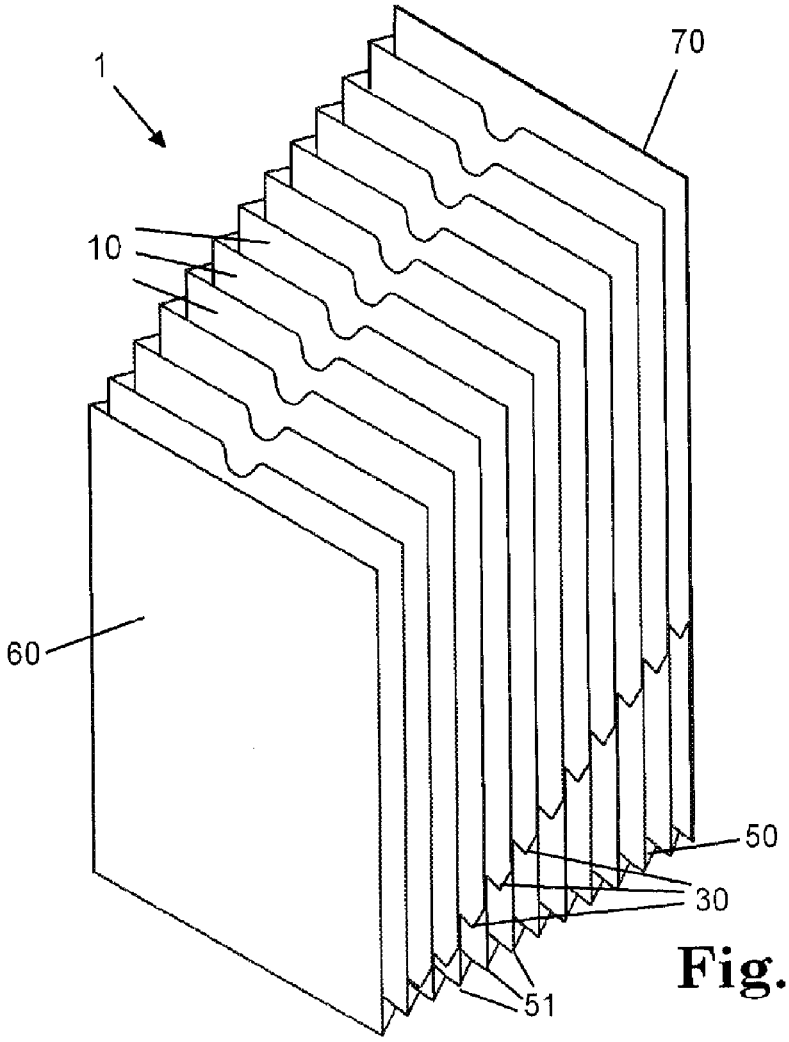
FIG. 3B is a full-width view of the interior of the folder, which has the left and right sides of the folder removed to expose the fold portions and troughs in the gusset.

FIG. 3B is a full-width view of the interior of the folder 1, which has the left and right sides of the folder removed to expose the fold portions 30 and troughs 51 in the gusset 50.

FIGS. 1A, 3A and 3B show how the dividers 10 fit into the gusset 50. Note the shape of each folded divider 10 from FIG. 1A. Note that the top portion 20 of each divider 10 extends laterally (left and right) into one particular groove or trough 51 in the gusset 50. From the top portion 20, the folded portion 30 extends toward the front 60 of the folder by exactly one trough 51. From the folded portion 30, the bottom portion 40 extends downward toward the bottom of the folder, and extends laterally into a trough 51 adjacent to the particular trough 51 noted above. In other words, the trough 51 that supports the bottom portion 40 of the divider 10 is different from the trough that supports the top portion 20, with the two troughs being directly adjacent to each other. Alternatively, the fold portion may extend forward by more than one trough, such as two troughs, three troughs, four troughs, and so forth.

Figure 4:
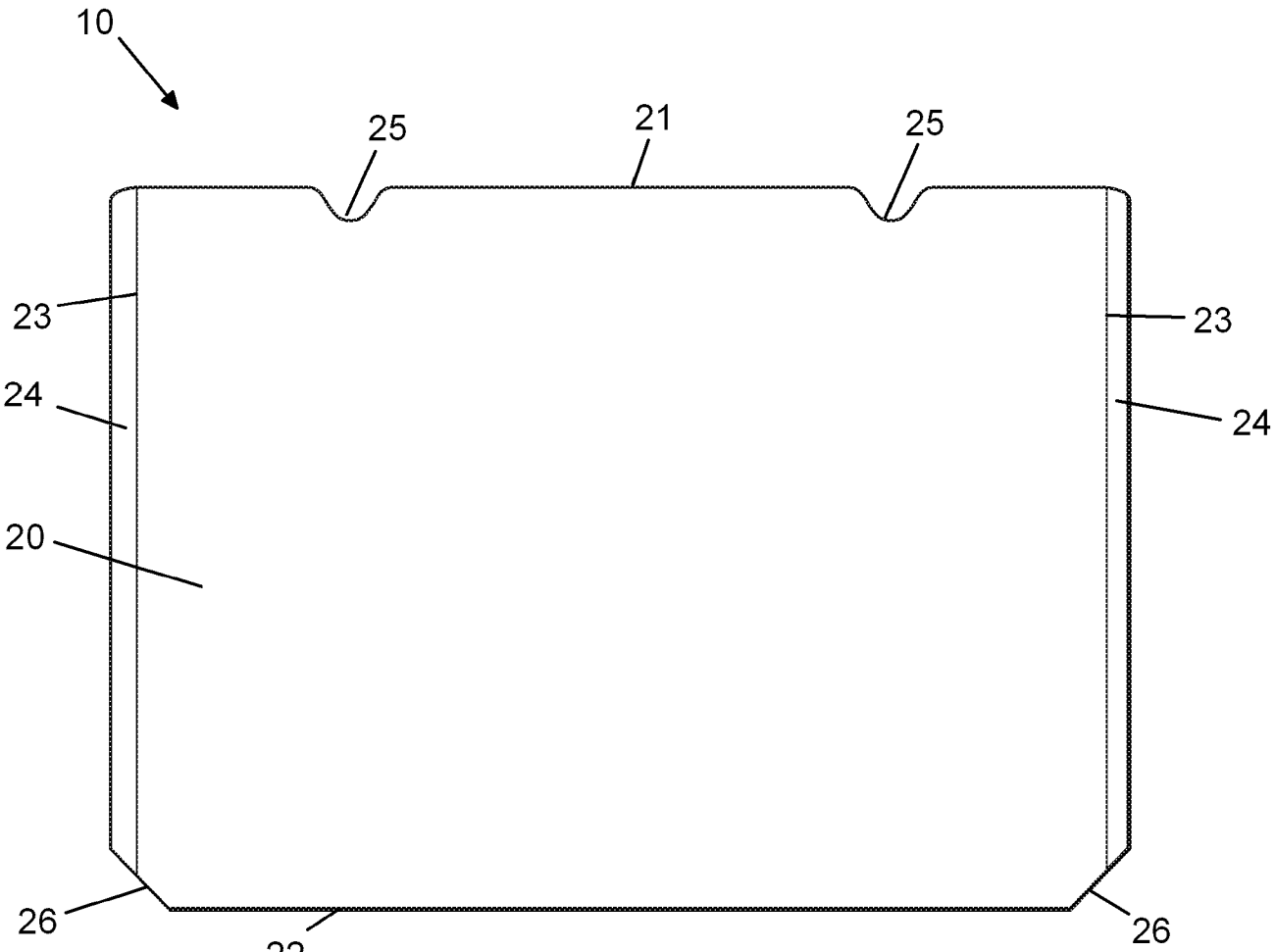
FIG. 4 is a front-view drawing of an exemplary top portion of a divider.

FIG. 4 is a front-view drawing of an exemplary top portion 20 of a divider 10.

The top portion 20 extends vertically from a top edge 21 down to a top fold 22. Below the top fold 22 is the folded portion, which is not shown in FIG. 4. The top edge may have one or more indentations 25 that can improve gripping of the particular divider for the user. In some cases, as is shown in FIGS. 1A, 2 and 3B, the indentations 25 are in the same locations for all the dividers. In other cases, the indentations 25 may be staggered or may vary laterally in location.

The top edge 21 of the divider may optionally include a label portion, on which the user may write or affix particular indicia for identifying the contents of the corresponding folder. Because of the stair-step effect of the folder 1, all or some of the label portions may be simultaneously viewed from the front 60 of the folder 1.

The lateral sides of the top portion 20 may have their bottom corners 26 clipped, so that the folded portion 30 (not shown) is laterally clear from the gusset 50. In general, it is desirable that the folded portions 30 be narrower than the interior width of the gusset 50.

The lateral sides of the top portion 20 may have optional folded wings 24. These wings 24 may be folded along fold lines 23, then inserted into corresponding troughs in the gusset. The wings 24 naturally unfold a bit when released, thereby forming a friction fit with the gusset 50 that helps keep the divider 10 in place. The wings 24 also strengthen the lateral sides of the dividers. Optionally, the dividers may be further glued in place with a suitable adhesive. In some cases, the adhesive may be applied on the wings 24.

Figure 5:
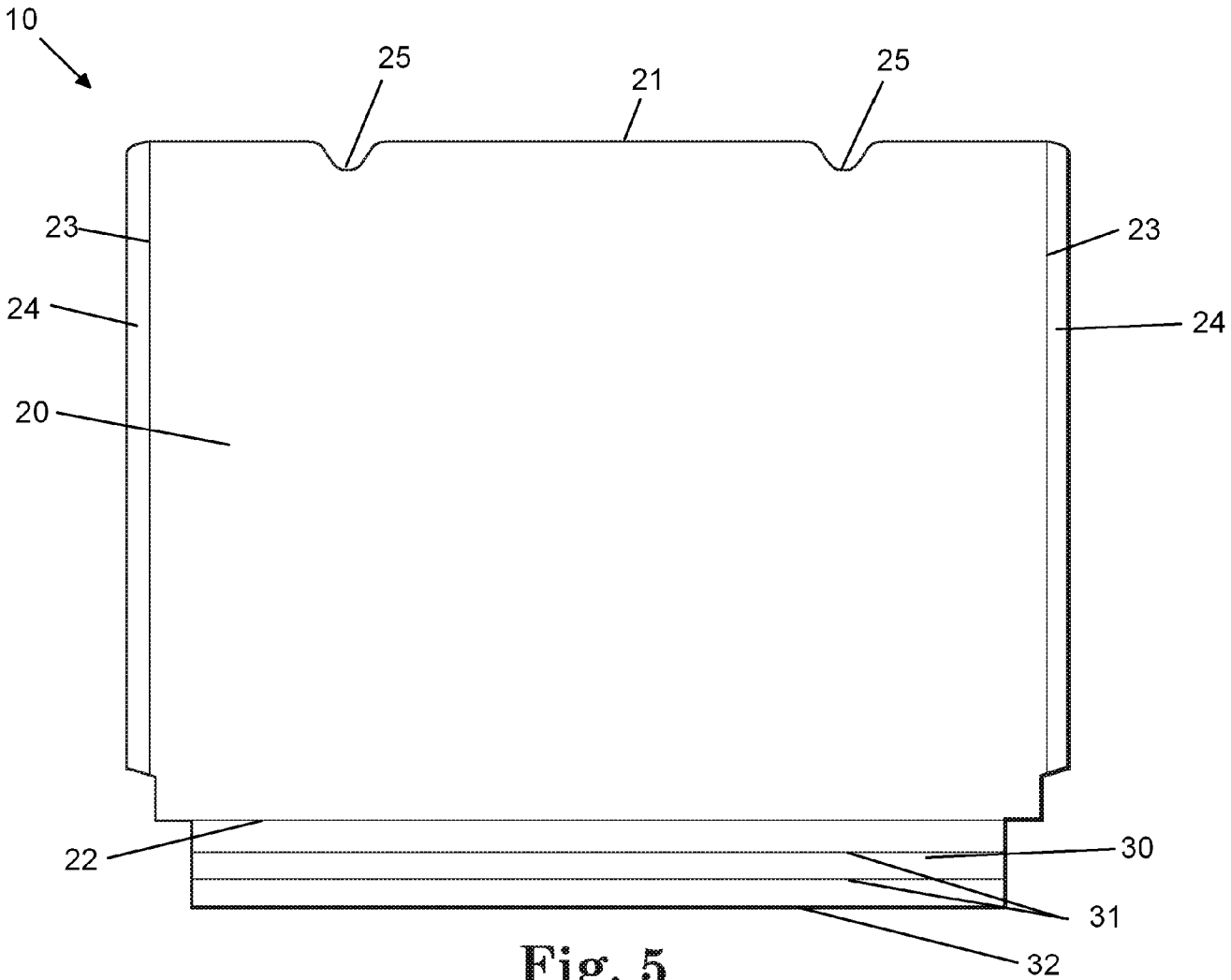
FIG. 5 is a front-view drawing of exemplary top and folded portions of a divider.

FIG. 5 is a front-view drawing of exemplary top 20 and folded 30 portions of a divider 10.

From the top fold line 22, the folded portion extends to the bottom fold line 32. In practice, the folded portion may extend away from the plane of the top portion 20; FIG. 5 shows the top and folded portions in an unfolded state, pressed flat. The folded portion 30 may include one or more additional folds 31. In some cases, the number of additional folds 31 may correspond to the number of pleats, folds, creases, troughs, or grooves in the expandable gusset, so that the folded portion may expand or contract along with the gusset. For instance, if the top and bottom portions of the divider are to fit into directly adjacent troughs in the gusset, there may be a single additional fold 31 in the folded portion 30. Other configurations are possible as well.

It should be noted that with one or more additional fold lines 31, the actual folded portion 30 may be essentially horizontal when the gusset is completely expanded, but may be compressed to lie essentially vertical when the gusset is completely compressed. For the purposes of this document, such a folded portion 30 is said to "horizontally extend" from one trough to another trough in the folder, even though the actual folded portion may truly extend with a downward component (pitch) from the top fold line 22 to the additional fold line 31, then with an upward component (pitch) from the additional fold line 31 to the bottom fold line 32. In other words, the horizontal extension may apply from the top fold line 22 to the bottom fold line 32, which may be truly horizontally (orthogonally) separated, even though the folded portion 30 that connects them may dip downward in the middle.

For purposes of this patent the term "generally orthogonal" is meant to mean "extending away" from the planar portion of the divider even if not truly orthogonal and regardless of the pitch. The figures show portion 30 has a pitch off the right angle and we intend to include this in our meaning of generally orthogonal. Notice though that this dip or pitch provides benefit to the user by helping to separate sheet of papers in a stair-step manner within the pocket. It is therefore possible to have a "double step" configuration where there are two folds 31 and 32 in succession (not shown) within each pocket to provide a shelf or step within the pocket for segregating papers.

Note that the preferred lateral width of the folded portion 30 is less than that of the top portion 20. While it is desirable that the top portion 20 engage a particular trough in the gusset, it is also desirable that the folded portion 30 be clear of the gusset.

Figure 6:
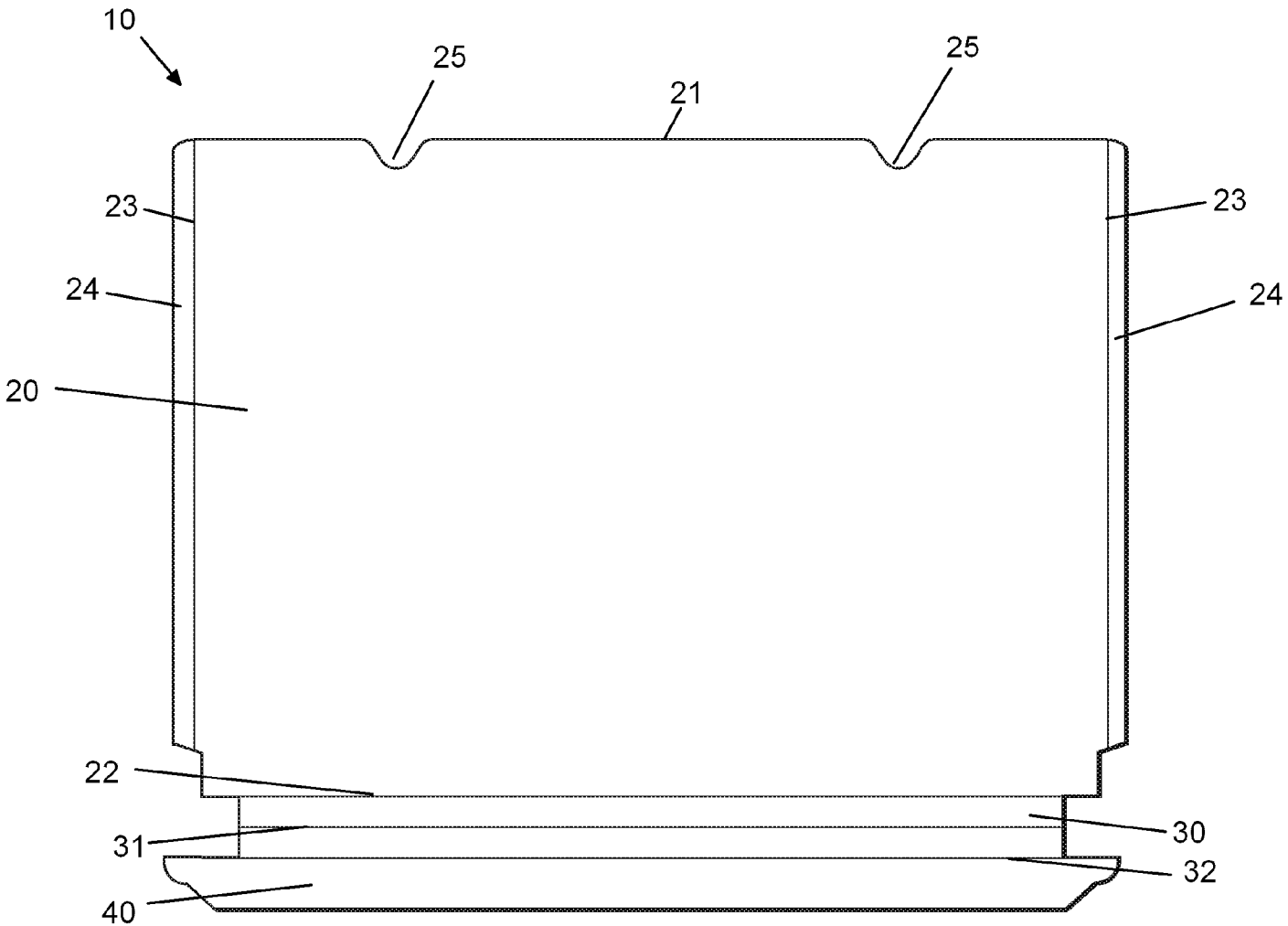
FIG. 6 is a front-view drawing of exemplary top, folded and bottom portions of a divider.

FIG. 6 is a front-view drawing of exemplary top 20, folded 30 and bottom 40 portions of a divider 10. Here, there is only one additional fold line 31 in the folded portion 30.

From the bottom fold line 32, the bottom portion 40 may be folded either upward, toward the top of the folder, or downward, toward the bottom of the folder. In either case, the bottom portion 40 may contact the adjacent divider, toward the front of the folder. In the region of contact, two dividers may both share a single trough in the gusset. Alternatively, the folded portion 30 may extend from the top portion 20 toward the back of the folder, and the bottom portion may not necessarily contact the adjacent divider.

In FIG. 6, the exemplary bottom portion 40 may not reach the bottom of the folder. Alternatively, the bottom portion 40 does reach the bottom of the folder, and may extend into a trough in the gusset for support.

Figure 7:
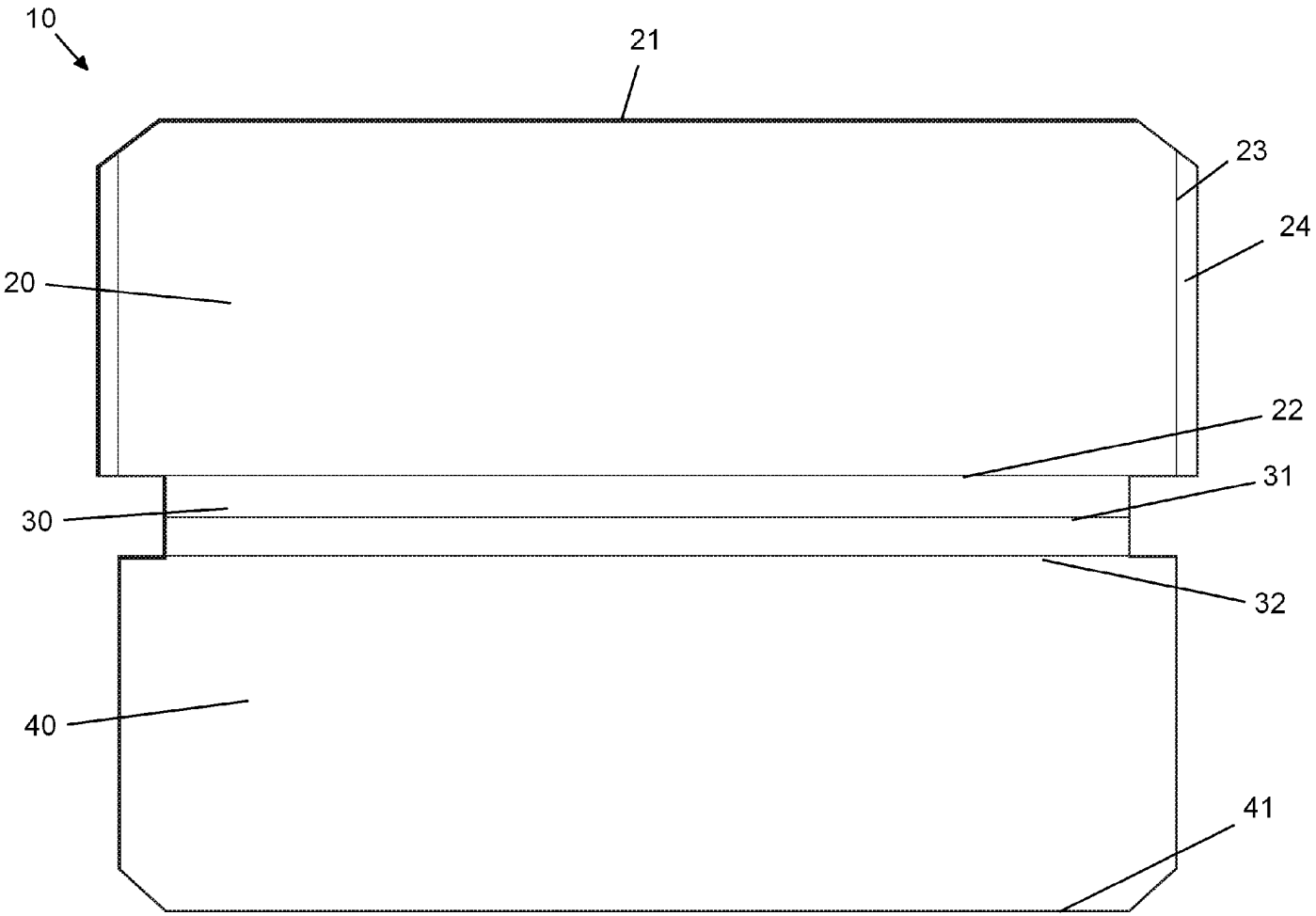
FIG. 7 is a front-view drawing of exemplary top, folded and bottom portions of a divider, in which the bottom portion extends down to the bottom of the folder.

FIG. 7 is a front-view drawing of exemplary top 20, folded 30 and bottom 40 portions of a divider 10, in which the bottom portion 40 extends down to the bottom of the folder. As with FIGS. 5 and 6, FIG. 7 shows the divider in unfolded form, pressed flat.

The bottom portion 40 extends vertically downward from the bottom fold line 32 to its bottom edge 41. In some cases, the bottom edge 41 fits into a trough in the gusset for support. In many cases, the bottom edge 41 fits into the same trough as the lateral sides of the bottom portion 40, so that the bottom portion is supported on three sides by the same trough.

The bottom edge 41 may optionally have its corners removed, in order to reduce interference with the bottom left and bottom right corners of the gusset.

Figure 8:
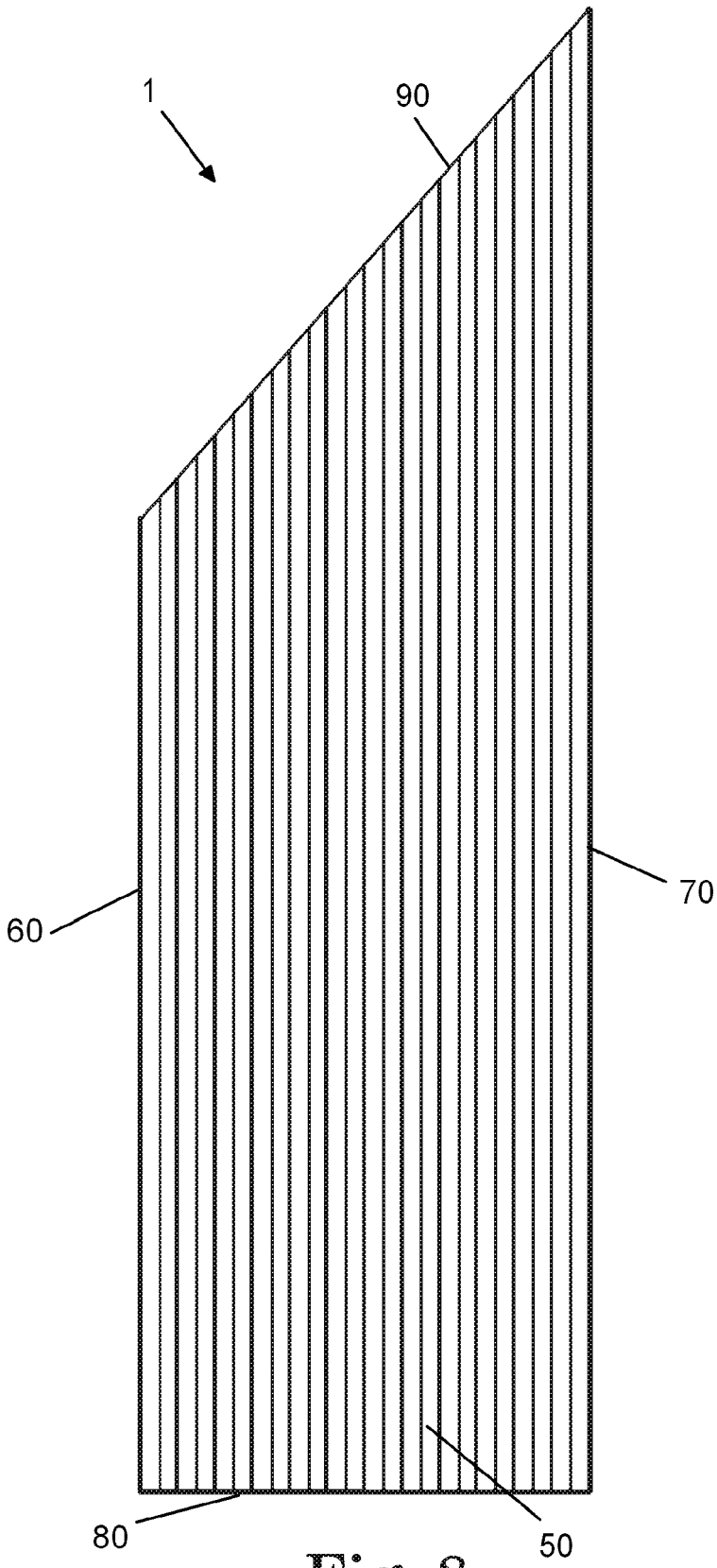
FIG. 8 is a right-side-view drawing of the assembled file folder.

FIG. 8 is a right-side-view drawing of the assembled file folder 1. The internal structure is essentially completely hidden by the gusset 50. We see the edges of the front face 60, the back face 70, the bottom 80 of the gusset, and the top 90 of the folder 1.

Note that the bottom 80 of the gusset is drawn in FIG. 8 as a plane, but may in practice include the pleats, folds, or ridges from the expandable gusset 50. Note also that the top 90 of the folder is also drawn in FIG. 8 as a plane, although away from the gusset in the interior of the folder, the folder may not have a single top surface. For instance, the folder may have pockets that open to the top, so that there is no single top surface, only the top edges of the dividers.

Figure 9:
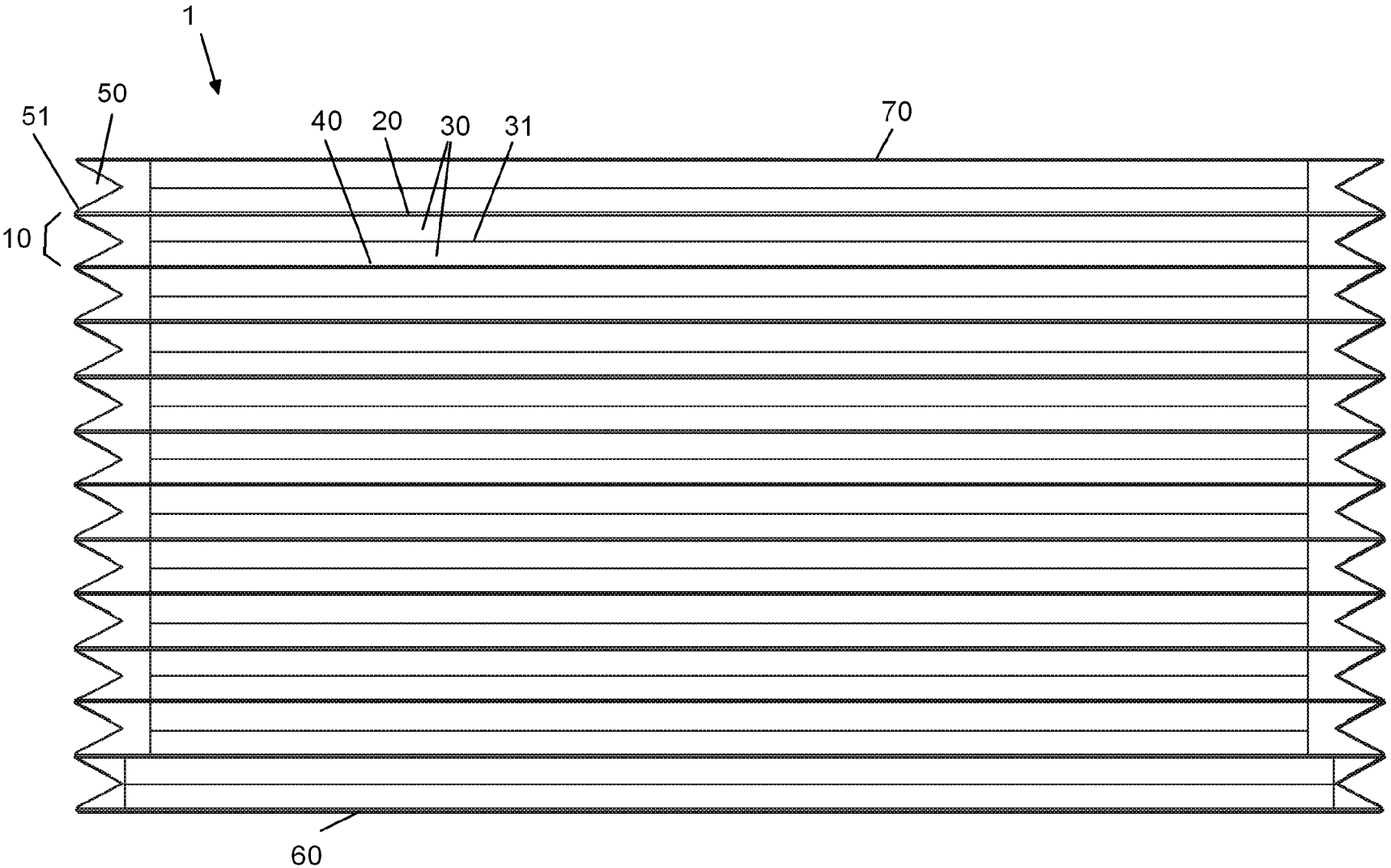
FIG. 9 is a top-view drawing of the assembled file folder.

FIG. 9 is a top-view drawing of the assembled file folder 1. The front face 60 is at the bottom of the drawing, and the back face 70 is at the top of the drawing.

FIG. 9 shows a series of pockets, as viewed from above. FIG. 9 includes element numbers for one particular divider 10, although it will be understood that other dividers are similar in function and construction. The top portion 20 of the divider 10 extends laterally into the trough 51 in the gusset 50. The top portion 20 extends from the top of the folder (closest to the viewer) downward (into the page) to the folded portion 30. The folded portion 30 extends generally toward the front 60 of the folder (downward in the drawing), with a single additional fold line 31. It is understood that the folded portion 30 may be expanded and contracted as needed, along with the gusset. The bottom portion 40 extends from the folded portion 30 toward the bottom of the folder (into the page).

Note that the frontmost pocket in the folder 1, adjacent to the front face 60 of the folder 1, may have a different structure than the other pockets. In this case, the pocket is formed from the front face 60 of the folder on its front, the expandable gusset on its lateral sides and bottom, and an unfolded divider on its rear.

Figure 10:
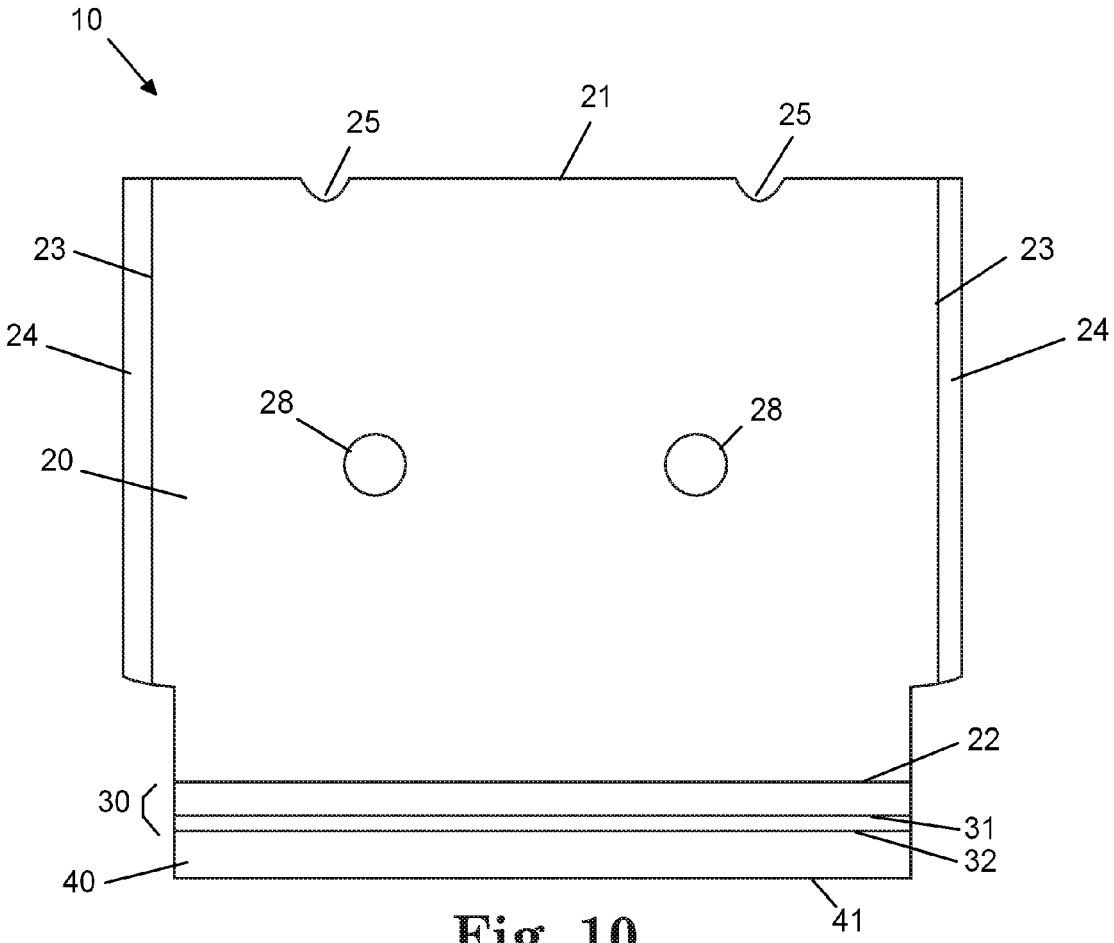
FIG. 10 is a front-view drawing of exemplary top, folded and bottom portions of a divider, in which the top portion includes one or more additional holes in its interior.

FIG. 10 is a front-view drawing of exemplary top 20, folded 30 and bottom 40 portions of a divider 10, in which the top portion 20 includes one or more additional holes 28 in its interior. Such optional holes 28 may aid the user in gripping a particular divider, much like the indentations 25.

Figure 11:
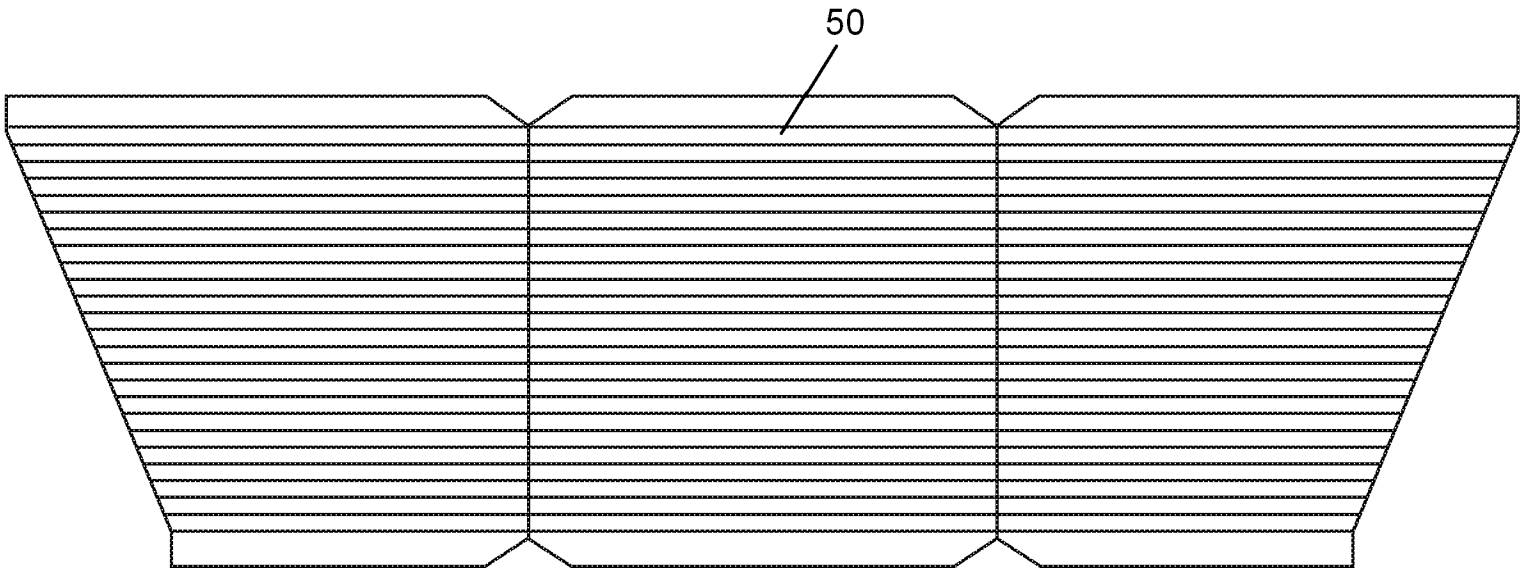
FIG. 11 is a top-view drawing of an unfolded gusset 50.

FIG. 11 is a top-view drawing of an unfolded gusset 50. In FIG. 11, the front of the folder is at the bottom of the drawing, and the back of the folder is at the top of the drawing.

Note that in most cases, the gusset 50 includes pleats, folds or troughs that extend over the entire gusset, namely from the top left of the folder, to the bottom left, to the bottom right, to the top right of the folder, when assembled. It may also be a web or net material, which may be elastic or inelastic.

The gusset 50 may be made from a single sheet, with appropriate accordion folds for expansion. There may be notches in the gusset at the bottom left front, bottom left back, bottom right front, and bottom right back corners of the folder, when assembled. These notches reduce or eliminate interference when the gusset is folded.

Finally, an example is provided to show a method of manufacturing the folder.

Figure 12:
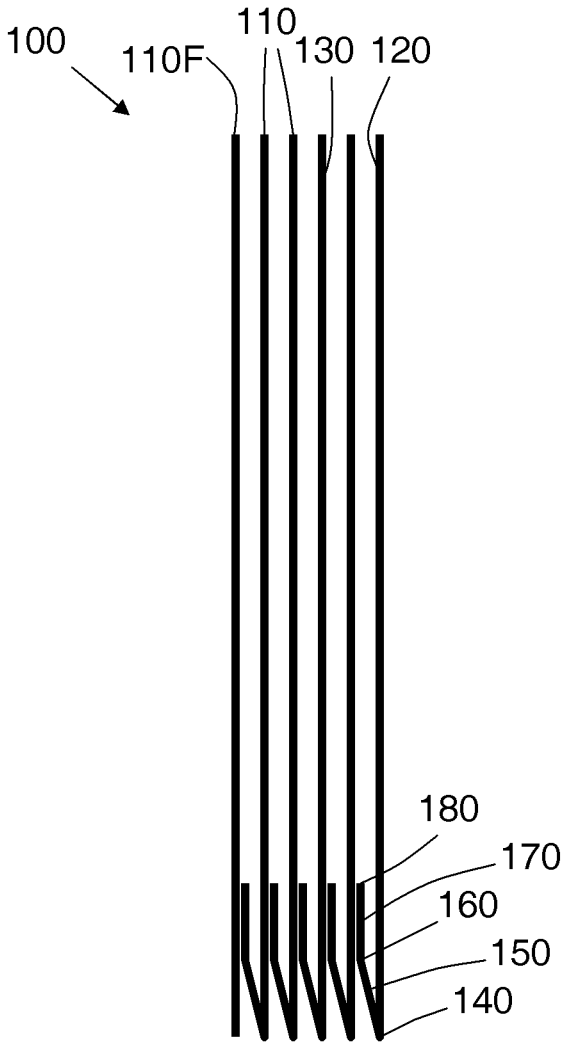
FIG. 12 is a side-view schematic drawing of a group of dividers in a compressed state, front-to-back.

FIG. 12 is a side-view schematic drawing of a group 100 of dividers 110 in an intermediate stage, prior to being joined to the gusset. The group 100 is constructed so that all the dividers 110 may be formed identically, except for the divider 110F at the front of the folder. Alternatively, the group may include dividers that are all identical except for the divider at the back of the folder. As a further alternative, the dividers at the front and back may be formed differently than the dividers internal to the folder.

In the example design of FIG. 12, each divider 110 is folded at its bottom toward the front of the folder, and attached to the adjacent divider. A pocket is formed by the front face 120 of a divider, the bottom 150 of the same divider, and the rear face 130 of the adjacent divider. In this manner, the vertical portion of each divider may define a front face of one pocket and a rear face of an adjacent pocket.

The divider 110 extends from the top downward to a rear fold line 140. The bottom portion 150 of the divider extends from the rear fold line 140 toward the front of the folder to a front fold line 160. The extension and relative angle of the bottom portion 150 may vary from largely vertical (when the group of dividers is in a largely compressed state, as in FIG. 12) to largely horizontal (when the group of dividers is expanded).

For the design of FIG. 12, beyond the front fold line 160, the divider 110 extends upward in an attachable portion 170. The attachable portion 170 extends from the front fold line 160 to an attachable portion edge 180. In other cases, the attachable portion 170 may extend downward from the front fold line 160, rather than upward. For most of these designs, the attachable portion is generally vertical, is generally parallel to the adjacent dividers, and is glued or otherwise fastened to the rear face 130 of the adjacent divider.

As an initial manufacturing step, the dividers are first formed from suitable card stock, paper, cardboard, or other suitable material.

The dividers are formed with a generally rectangular shape, with optional lateral "wings" (as in FIGS. 4-7) that may each include a score line, perforations, or a fold line. The dividers may also include one or more indentations or holes that can assist in gripping. (See, for instance, element 25 in FIG. 4). In general, the dividers are identical in size and shape except for either a front or a rear divider in the folder or in the case where the depth of the adjacent pockets (stairs) is to be unequal, in which case they may have different depths.

A divider is folded along its rear fold line 140 and front fold line 160. Adhesive is then applied to the attachable portion 170, and it is adhered to an adjacent divider. Alternatively, the adhesive may be applied to the appropriate location of the adjacent divider, or a combination of the two.

Once the divider is attached to its adjacent divider, the process is repeated serially or simultaneously until the front (or rear) end of the folder is reached. The folder may have any suitable number of pockets, including 2, 3, 4, 5, 6, 7, 8, 9, 10, 11, 12, or more than 12.

In FIG. 12, the adhesive is located in the small, vertical spaces between attachable portions 170 and the rear faces 130 immediately to the left of them.

Once the dividers are all attached to each other, and are generally compressed against each other to set the adhesive, front-to-back, they form a group 100 having a generally rectangular footprint. When the group is compressed, the top edge of each divider extends to the top of the group, and no divider extends upwards (toward the top of the group) significantly more than any other divider.

Figure 13:
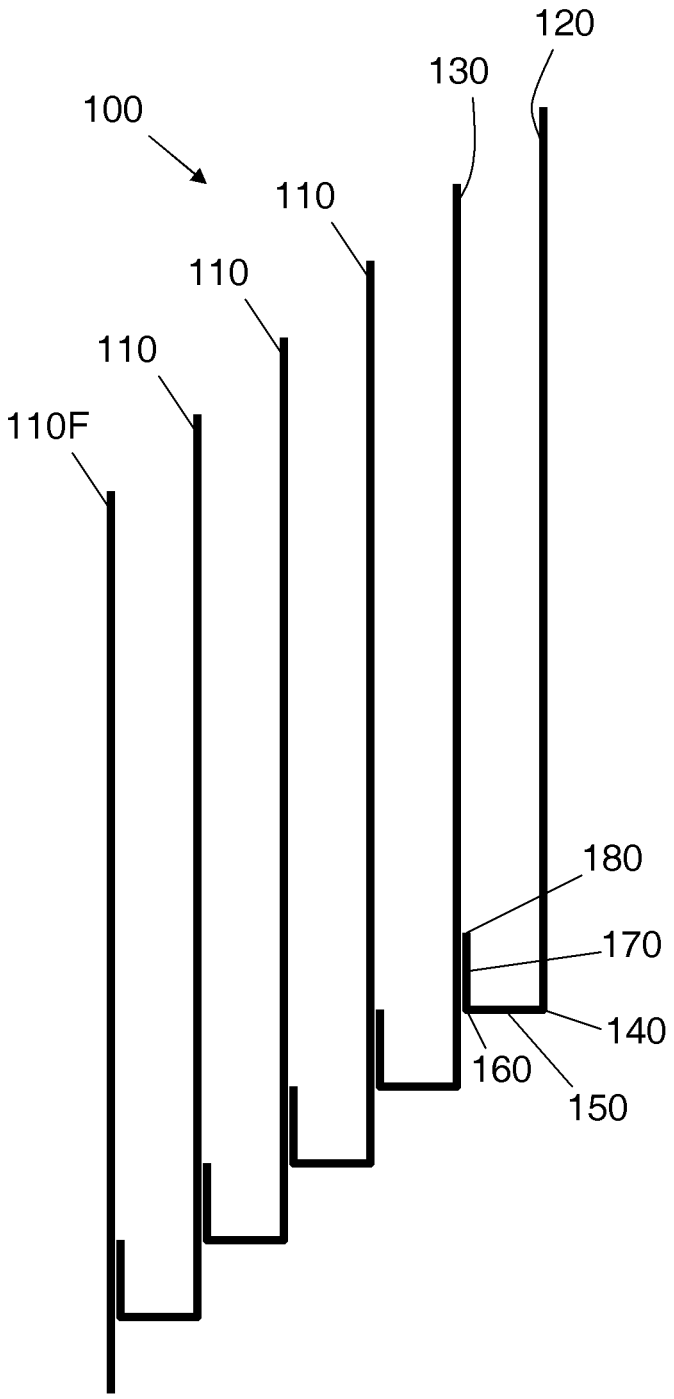
FIG. 13 is a side-view schematic drawing of the group of dividers of FIG. 12, in a splayed state.

Once the group 100 of dividers is formed, with each divider being glued or otherwise attached to its adjacent dividers, the group may be splayed or spread out, as in FIG. 13.

The bottom portions 150 of the dividers may be extended so that the dividers 110 have a significant separation between them while remaining parallel. When viewed from the side, as in FIG. 13, the splayed group 100 of dividers 110 takes on the stair-step shape of the folder. Specifically, when splayed, each divider in the group extends upwards farther than the divider in front of it, so that the top edges of the dividers may all be viewed simultaneously.

The group 100 of dividers 100, in this splayed state, may be inserted into appropriate slots in a gusset, or may be surrounded (laterally, plus bottom) by a gusset having appropriately-spaced features.

There are some aspects of the method of manufacture which require further explanation. Reference is made to FIGS. 12 and 13. The plane of the bottom portions 150 is horizontal when the dividers are compressed together, as in FIG. 12, but becomes inclined when the dividers are spread out, as in FIG. 13. Typical tooling for manufacturing folders is configured to handle only a single plane for the bottom portions of the dividers. Such a plane may be horizontal or inclined, but in general, the plane does not vary in inclination with the compression or expansion of the folder.

Figure 14:
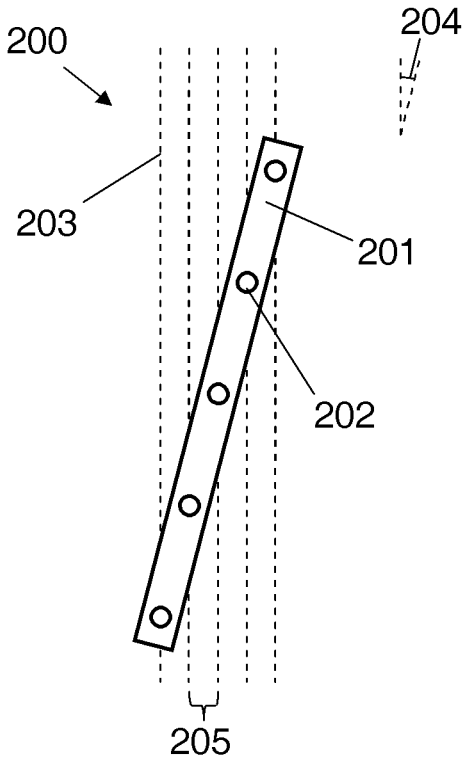
FIG. 14 is a bottom-view schematic drawing of a folder in the compressed state, along with associated tooling.
Figure 15:
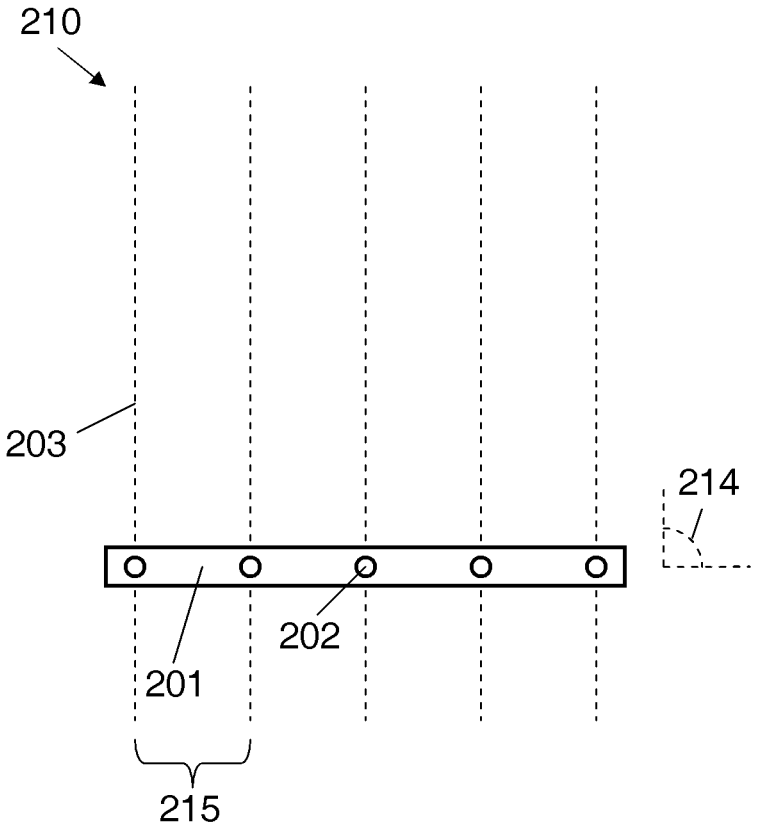
FIG. 15 is a bottom-view schematic drawing of a folder in the expanded state, along with associated tooling.

To show how typical tooling may compress and expand the pockets of the folder, FIGS. 14 and 15 are bottom-view schematic drawings of folders in the compressed and expanded states, respectively, along with associated tooling. In both, the tool 201 is rotatable in a plane that includes the bottom portions of the folder, which is typically a horizontal plane. The tool 201 includes several fingers 202 that are regularly spaced apart in a line along the tool 201. In general, the number of fingers 202 on the tool is the same as the number of pockets in the folder, although any suitable number of fingers 202 may be used.

Each finger 202 corresponds to a bottom portion of a particular pocket in the folder. For simplicity, the center of each bottom portion is represented as a vertical line 203 in FIGS. 14 and 15.

In the compressed state 200, the line of fingers 202 forms a relatively small shallow acute angle 204 with the pockets (represented by lines 203 when viewed from the bottom of the folder). The spacing 205 between adjacent dividers, or, equivalently, the pocket size, is the product of the spacing between adjacent fingers 202 and the sine of the angle 204. In the compressed state, the spacing 205 between adjacent dividers is relatively small. In the expanded state 210, the tool 201 is rotated to form a relatively large (preferably right) angle 214 with the pockets (lines 203). As a result, the spacing 215 between adjacent dividers is relatively large.

In practice, the tool 201 may rotate controllably during the manufacturing process, and may therefore control the relative expansion and compression of the pockets of the folder as needed.

Note that although the fully expanded state 210 is shown as having a 90 degree angle between the tool 201 and the pockets (lines 203), alternative geometries may be used. For instance, in some cases it may be desirable to have a larger spacing between adjacent fingers 202 on the tool 201, so that a smaller range of angles (acute to less than 90 degrees) may be used. In some cases, such a smaller range of angles may require less overall movement of the tooling, which may be desirable in certain instances. The reduced range of angles may not extend fully to 90 degrees.

For typical folders, in which the bottom portions of the pockets remain in the same generally horizontal plane for all expanded and contracted states, the tool rotates within the generally horizontal plane, and the fingers stay in contact with the pockets throughout all stages of expansion and compression.

However, for the present folder, in which the bottom portions of the pockets do not remain in the same plane for all expanded and contracted states, the fingers may lose contact with the pockets when the pockets are expanded, unless some of the tooling geometry is modified.

Figure 16:
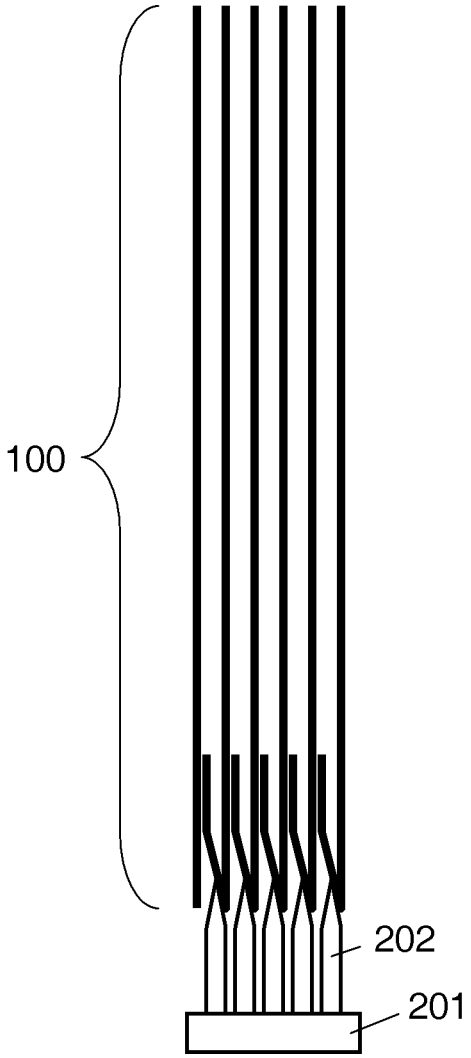
FIG. 16 is a side-view schematic drawing of a folder in the compressed state, along with associated tooling.

Consider the side-view schematic drawing of FIG. 16, which is analogous to the bottom-view schematic drawing of FIG. 14. In FIG. 16, the group 100 of dividers is in the compressed state, and the tool 201 is angled (as in FIG. 14) so that the fingers 202 contact the bottom portions of their respective pockets. Note that in FIG. 16, the rightmost finger 202 on the tool is either closer to or farther away from the viewer than the leftmost finger 202, depending on the orientation of the angle 204 in FIG. 14.

For expansion of the pockets to a particular predetermined size, so that the group 100 of pockets may be inserted into a gusset (or, a gusset wrap may be applied around the pockets), the entire group 100 may be rotated to keep the bottoms of the pockets roughly coplanar and roughly coincident with the tips of the fingers 202 on the tool 201.

Figure 17:
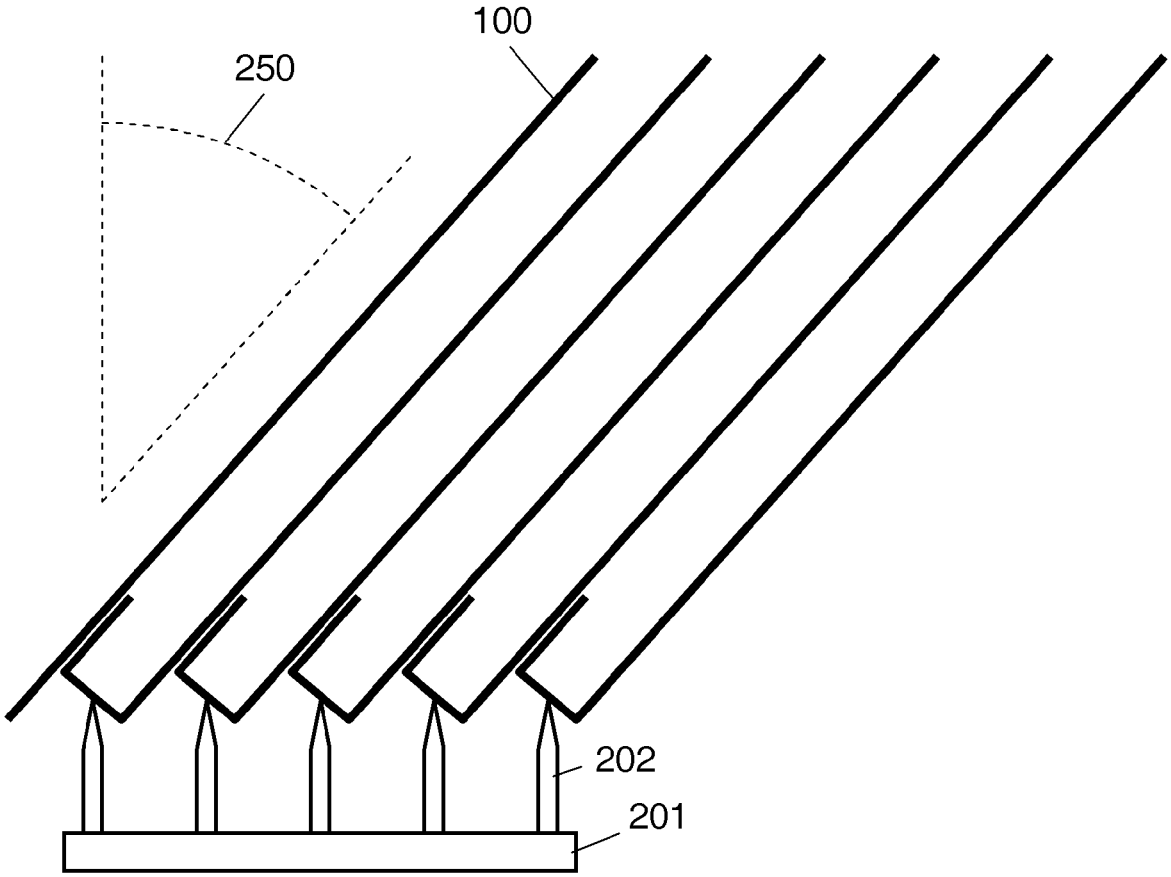
FIG. 17 is a side-view schematic drawing of a folder in the expanded state, along with associated tooling.

For instance, FIG. 17 is a side-view schematic drawing of a group 100 of pockets in its expanded state, rotated by an angle 250 (in the plane of the page) to keep the bottoms of the pockets roughly coincident with the tips of fingers 202. FIG. 17 is analogous to FIG. 15, in which the tool 201 is roughly perpendicular to the pocket directions. It will be understood that any suitable angle 214 may be used, and angle 214 need not be 90 degrees when the folder is fully expanded.

There are two angles involved with the expansion/compression tooling. A first angle, such as angles 204 and 214 in FIGS. 14-15, adjusts the center-to-center spacing of each divider. This first angle is in the plane of the page for FIGS. 14-15, and is out of the page in FIGS. 16-17. A second angle, such as angle 250 in FIG. 17, ensures that the bottoms of the pockets remain in contact with the tooling fingers 202 as the pockets are expanded. This second angle is in the plane of the page for FIG. 17, and would be out of the plane of the page, to the left or to the right, in FIG. 15.

Note that the actual depth of each pocket (i.e., the center-to-center spacing of the pockets when measured along a horizontal axis, as in FIG. 13) is the cosine of angle 250, multiplied by the product of the spacing between adjacent fingers 202 and the sine of the angle 204/214.

An exemplary method for manufacturing the folder may be as follows.

Initially, one fabricates a group of attached dividers. Each divider may be generally folded into a rectangular profile or have a planar portion and two successive orthogonal folds at one end to create a flat bottom "J" shaped end. Then, successive dividers are loaded into a jig that simultaneously holds all dividers adjacent to each other in a stair-step relationship (each successive divider offset longitudinally with respect to the next). The attachable portion 170 of each divider is adhered/bonded to the back of the elongated portion 110 of the adjacent divider.

So at the time the adjacent dividers are bonded to each other, they are in the splayed orientation of FIG. 12. The dividers are offset with respect to each other adjacent but with their bottom surface in a planar orientation as shown in FIG. 12.

Once the dividers are bonded to each other, it is necessary to change the orientation of the dividers from their current position with a planar bottom (successive bottom folds in a single plane generally orthogonal to the sidewall 110, as in FIGS. 8 and 12, to their final stair step orientation where the fold 140 is preferably orthogonal to the longitudinal portion 110 and bottom 150 as shown in FIG. 13.

This change in orientation is preferably accomplished in a holder/jig which preferably includes a plurality of spaced apart fingers 203 which are inserted into the pockets between dividers, and an external second set of spaced part fingers 202 is then applied into the bottom recesses created by the bottom fold lines, as shown in FIG. 16. In a broader sense, if one maintains contact with the bottom of the pocket while tilting the divider walls by angle 250, then the divider bottoms will have a stairstep orientation. Maintaining contact with the bottom of each pocket is best done by contacting the pocket from inside and out simultaneously, but could be done on one side alone. Then while the dividers are engaged by fingers 202 and 203, the jig is pivoted from a position of a planar bottom (FIG. 16.) to a position of a stair step bottom (FIG. 17). This is accomplished by changing the angle 205 of fingers 203 with respect ground, but keeping the fingers 203 parallel to each other. This will splay out the dividers into their stair step orientation for final assembly.

The final assembly involves applying a gusset wrap around three sides of the jig: bottom and two sides, leaving, of course, the top open.

The gusset material is sized to have the width of the final pocket folder and has been pre-corrugated to correspond to the number of dividers to provide the proper accordion function.

The gusset 50 (FIG. 11) must be bonded to the dividers on their side tabs 24 (FIG. 4) and along parts of the bottom corrugations. This is preferably accomplished by applying adhesive in the forenamed places and applying the gusset 50 under pressure. Pressure is supplied with the jig in the tilted position mentioned above an then applying a stair step die member which engaged gusset in its accordion folds an applies sufficient pressure between the accordion folds of the gusset to the dividers 110 at their lower end 42 (See FIGS. 1*a* and 1*b*). If hot melt adhesive is used, a heater element also having a stair step heating element can be applied in the folds until the gusset is bonded to the dividers.

At the connection between adjacent dividers, each divider has two parallel, horizontal fold lines. Between the two fold lines is a so-called "fold portion" that forms the floor of each pocket. "Above" both fold lines, each divider is generally planar, and forms the back wall of each pocket. "Below" both fold lines, each divider is attached to the adjacent divider toward the front of the folder, with an adhesive or by another suitable attachment. When the group of dividers is compressed, each divider in the group subtends generally the same footprint. When the group of dividers is expanded, the rear wall of each pocket extends upward higher than the corresponding front wall, so that the tops of the pockets are all viewable and all accessible simultaneously, without the need for flipping through successive pockets in the folder. The group of dividers may resemble group 100 from FIGS. 12-17, or any other suitable group.

Once the group of dividers has been bonded to each other a plurality of fingers is inserted into the bottom of the group, with each finger contacting a respective fold portion of a particular pocket. The fingers may resemble the fingers 202 on the rotatable tool/jig 201, for which the rotation of the tool determines the front-to-back spacing of the fingers 202.

The front-to-back spacing of the fingers is then increased. For instance, as in FIGS. 14-15, the tool 201 is rotated, which increases the angle from 204 to 214 and increases the front-to-back spacing from 205 to 215. Each finger pushes on a respective fold portion on the bottom of a respective pocket, and collectively, the group of dividers is expanded.

As the group of dividers expands, it is tilted front-to-back, so that the bottoms of the pockets remain roughly in the same plane as the tips of the fingers. For instance, the group 100 may be tilted back by angle 250, as in FIG. 17. The tilting may occur simultaneously with the front-to-back expansion of the fingers, so that the fingers preferably never become separated from their respective pocket bottoms during expansion of the dividers.

Once the group of dividers is expanded to a particular size (as in FIG. 13, for instance), the dividers may be inserted into a gusset (or the 3-sided gusset may be applied around the dividers and adhered/bonded by their side tabs 24 (see FIG. 4) or other suitable mechanism for supporting the dividers and forming the pockets.

Note that in FIGS. 1A and 1B, the dividers extend from the slanted topmost edge of the folder, down to the bottom of the respective pockets, forward to the adjacent divider, and down to the flat bottom edge of the folder. An alternative to this geometry is shown in FIGS. 18 and 19.

Figure 18A:
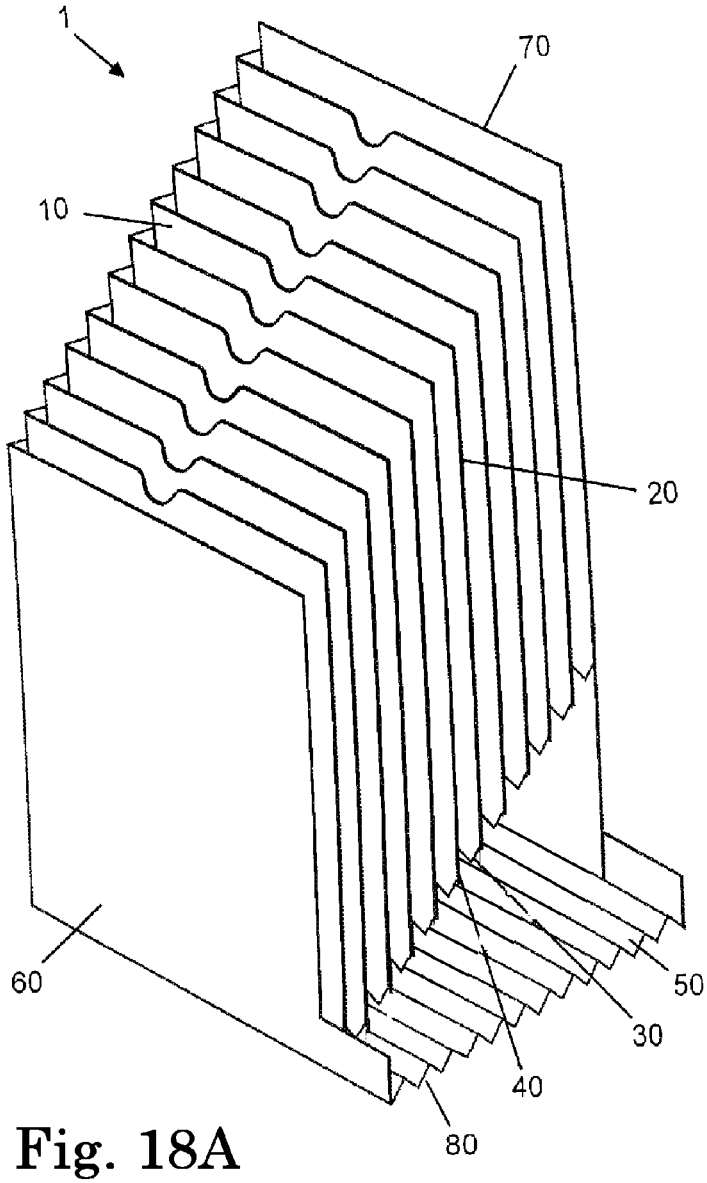
FIG. 18A is a cutaway drawing of the interior of an expandable stair-step folder.
Figure 18B:
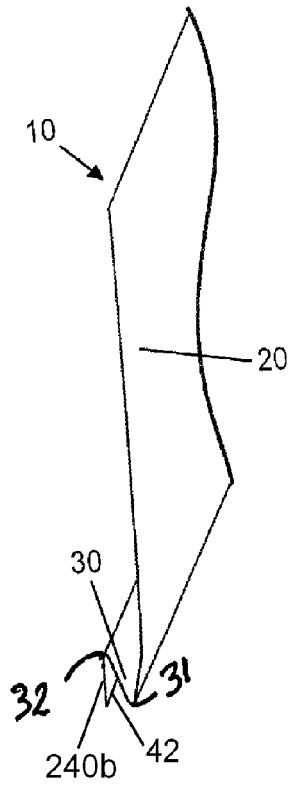
FIG. 18B is a cutaway drawing of one divider, viewed from the right/rear sides.
Figure 19A:
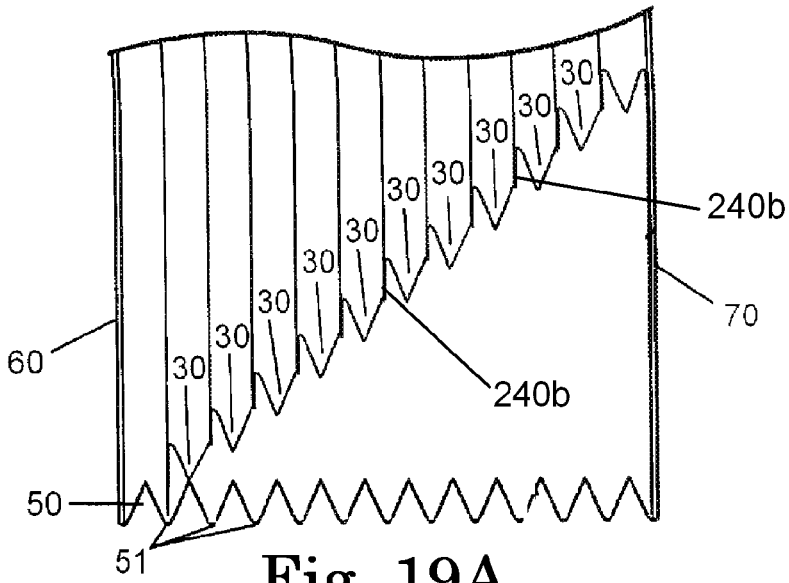
FIG. 19A is a close-up view of the folded portions and the expandable gusset at the bottom of the folder.
Figure 19B:
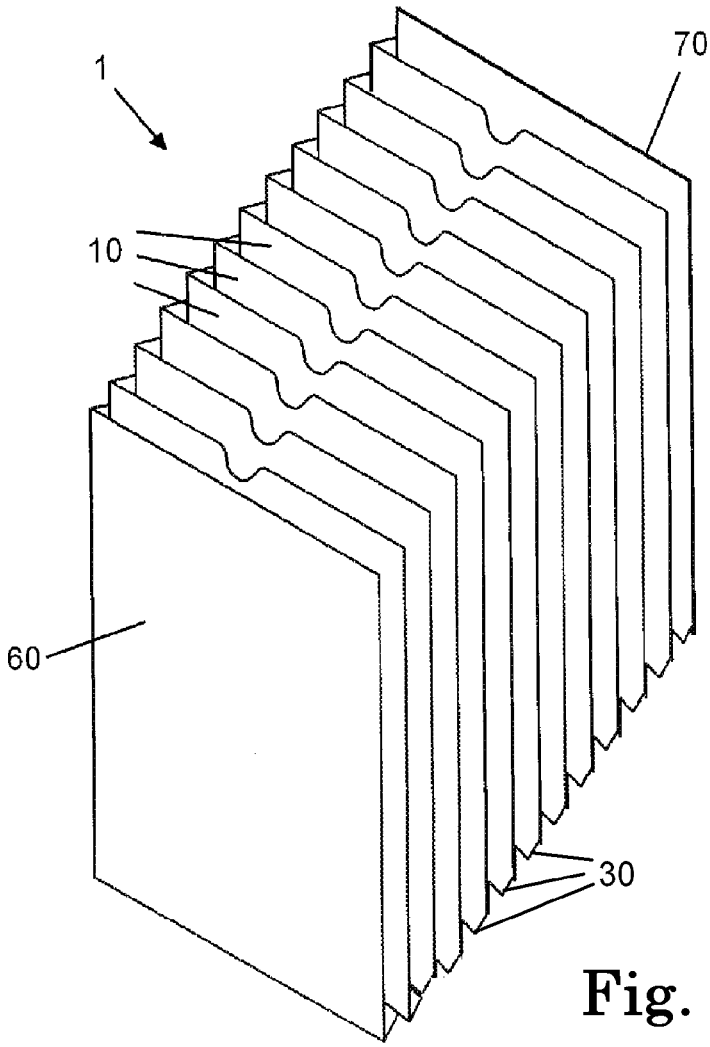
FIG. 19B is a full-width view of the interior of the folder, which has the left and right sides of the folder removed to expose the fold portions and troughs in the gusset.

FIG. 18A is a cutaway drawing of an alternative interior of an expandable stair-step folder. FIG. 18B is a cutaway drawing of one divider from the folder, viewed from the right/rear sides. Unlike the dividers in FIGS. 1A and 1B, the dividers in FIG. 18 extend only a small portion 240*b* downward from the adjacent divider, rather than extend downward fully to the bottom edge of the folder (portion 40*b*). This small portion 240*b* of downward extension may be used for adhering the divider to the adjacent divider, and may be used for the application of glue or other suitable adhesive.

In the preferred embodiment, therefore, each divider terminates at its lower end with two folds, one (30) creating the bottom crease 31 and the other 32 creating the attachment tab 240*b*. Element 70 is not part of the divider system but part of the gusset/web which is wrapped on later.

There may be advantages to having the dividers as shown in FIG. 18. For instance, the internal dividers may all have a uniform size, rather than increasing in size from the front of the folder to the back of the folder. Note that the dividers at the front and rear faces of the folder may still be sized differently than the internal dividers. As another example, the internal dividers may all be folded in the same location on the divider, rather than at a different location for each divider. In some cases, this uniformity in sizing and folding may be advantageous for manufacturing the folder.

Figure 20:
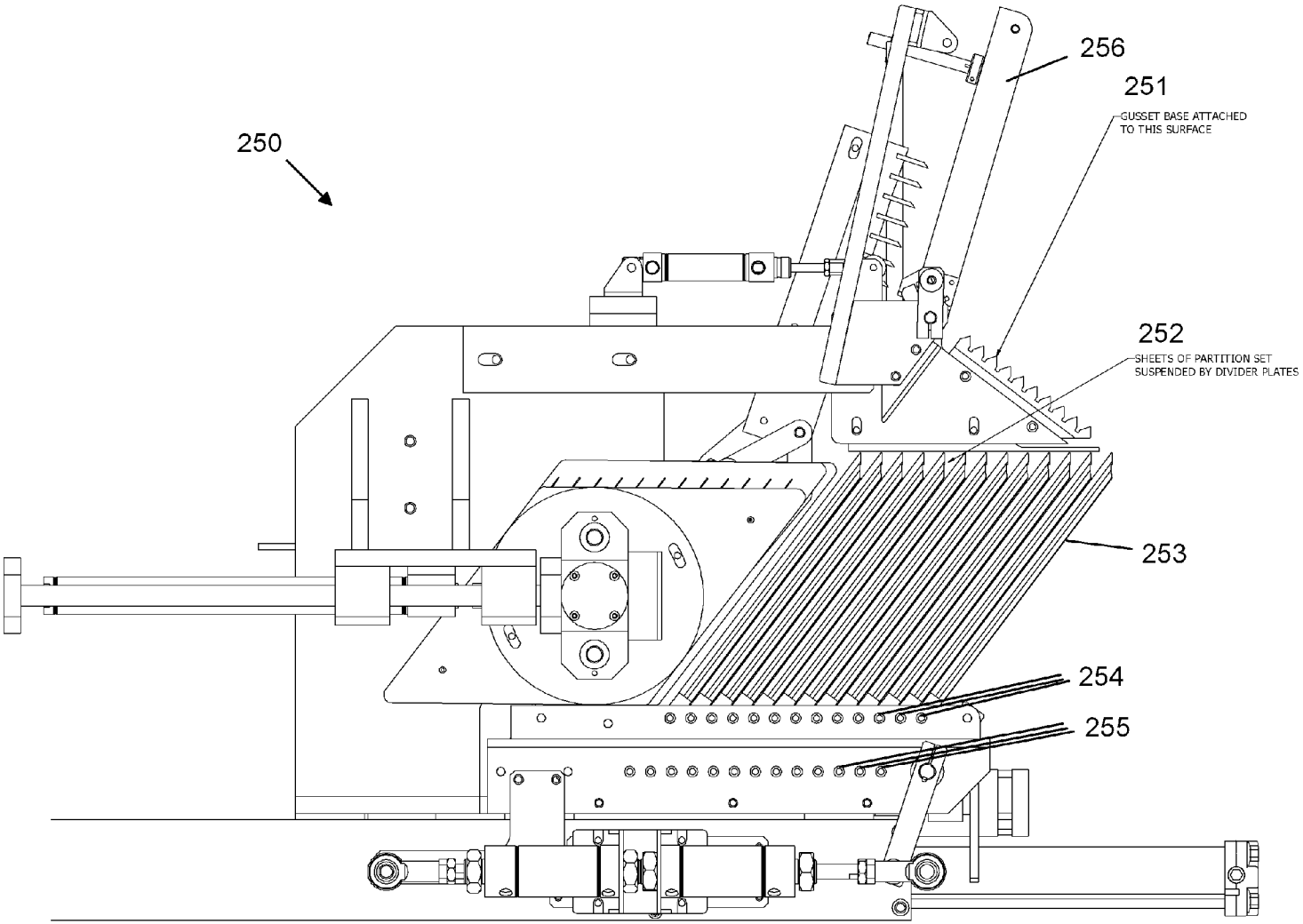
FIG. 20 is a side-view drawing of an exemplary gusset attachment fixture assembly 250.
Figure 21:
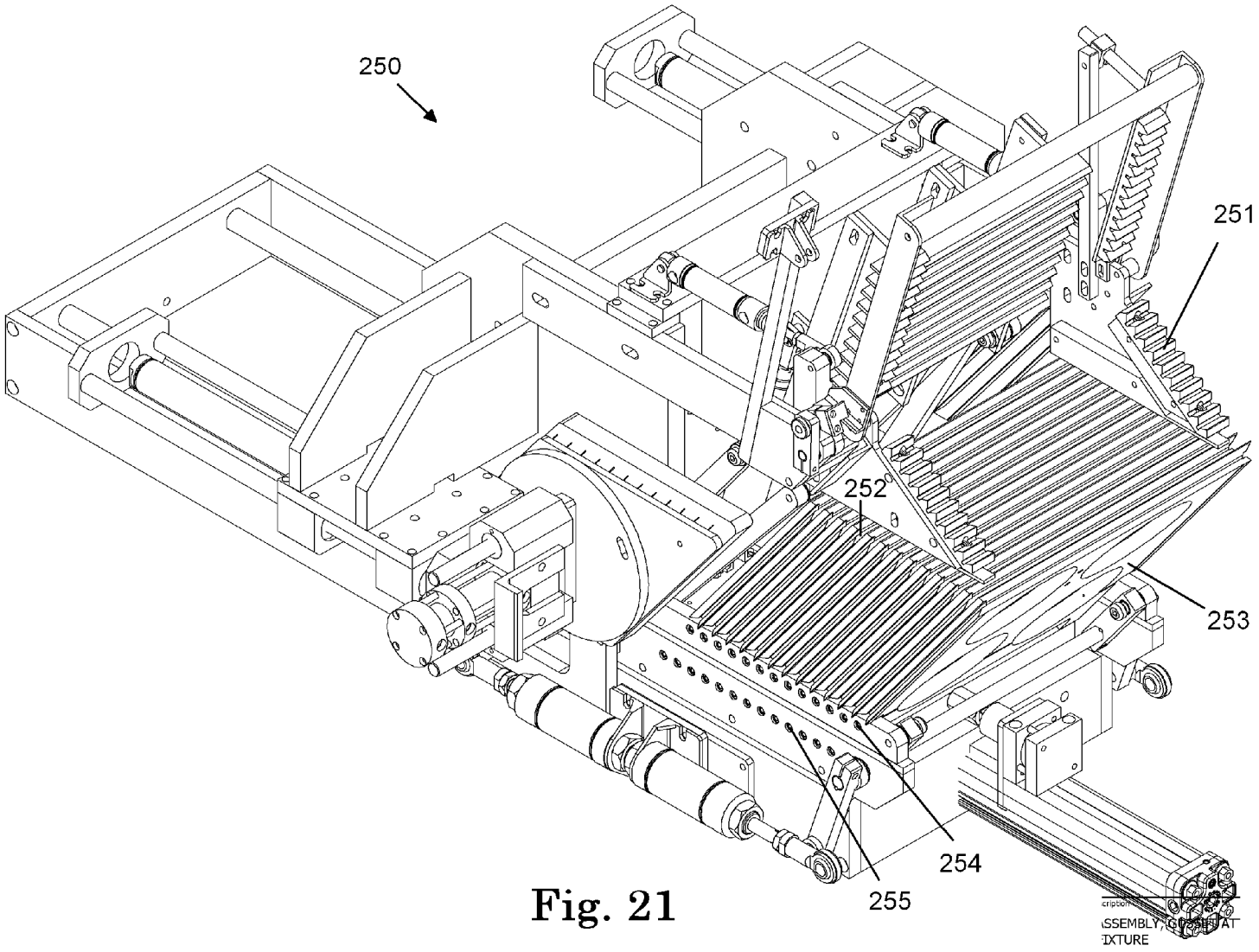
FIG. 21 is a plan drawing of the assembly 250 of FIG. 20.

FIG. 20 is a side-view drawing of an exemplary gusset attachment fixture assembly 250. FIG. 21 is a plan drawing of the assembly 250 of FIG. 20.

For assembly of the folder, the individual dividers are placed in a series of parallel and adjacent plates 253, with a plate between adjacent dividers. The dividers include side attachment portions 24 (FIG. 7) which will later be used to adhere to the gusset wrap. The plates 253 themselves are tiltable in unison within the fixture, and are anchored at hinge points 254 and 255. The hinge points themselves are arranged along two lines, with each line being disposed on its own subassembly. The two hinge subassemblies are translatable with respect to each other; in the view of FIG. 20, the translation is horizontal. As one set of hinges translates with respect to the other, the plates rotate around the pivot 254.

The bottom edges of the individual dividers are suspended by a series of divider plates 252. In the view of FIG. 20, the dividers are oriented essentially upside down from their intended use in the completed folder.

Likewise, the bottom edge of the gusset is attached to a wed shaped ramp having a stairstep surface 251, and is hung downward over the lateral edges of the dividers. In the view of FIG. 20, the side edges of the gusset are parallel to the page, one side facing the viewer, and the other side being hidden by the fixture 250. The gusset is hung at an angle, with respect to horizontal, so that the sides of the gusset extend parallel to the side edges of the plates. Again, in the view of FIG. 20, the side edges of the gusset hang from the top-right to the bottom-left.

Note that there is a wedge-shaped portion between the ramp surface 251 that supports the gusset base and the plane that includes the divider plates 252 (the plane being horizontal in FIG. 20). This wedge-shaped portion may be left hollow in the assembled folder, or may optionally include a wedge-shaped support that may give additional strength to the pockets.

When the gusset and dividers are arranged in place, a press 256 may pivot and/or translate onto the wedge shaped ramp gusset-base-supporting surface 251, and may optionally apply pressure to appropriate surfaces while glue dries or cures. Notice that the ramp has a slop angle which is substantially defines the stairstep slope of the dividers.

An exemplary method for assembling the folder is presented below. Note that this is only one possible assembly method, and any suitable assembly method may also be used.

The dividers are first cut and gathered. For particular configurations of the folder, each divider is the same shape, which greatly simplifies the manufacturing process for the folder. The dividers are then folded into the "J" shape, where the "right side" of each "J" forms the back of a pocket, the "bottom" of the "J" forms the bottom of the pocket, and the short "left side" of the "J" is to be attached to the divider in front of it.

Once folded, the dividers are then glued to their adjacent dividers, with glue applied to the short "left side" of each "J". Each divider is glued "higher up" than the divider in front of it, so that when the dividers are extended along strictly horizontal and vertical directions, the pockets ascend from the front of the folder to the back of the folder. The assembled packet of dividers is ready to be attached to the gusset. Such assembly is performed by the tooling of FIGS. 20-21.

The divider packet is inserted, top down, into the fixture of FIG. 20, with each divider being inserted between its own pair of respective parallel plates. During insertion, the plates are vertically oriented, or fairly close to vertical.

Once the packet of dividers is inserted, the plates tilt downward, closer to horizontal, until the divider packet reaches the extension that is used in the completed folder. In most cases, this extension is when the floor of each pocket is roughly perpendicular to the walls of the pocket.

Note that when the dividers are fully inserted into the series of plates, the lateral ends of the dividers extend horizontally beyond the ends of the plates. This allows the tooling to bend the lateral flaps of the dividers while the dividers are still engaged within the plates. This is typically the next manufacturing step. In most cases, the lateral flaps of the dividers are bent toward the front of the folder, although they may also be bent toward the back of the folder. The folded lateral edges may provide a gentle friction fit between the dividers and the side portions of the gusset, or may optionally be used to hold adhesive if the dividers are glued to the gusset.

Once the lateral flaps are bent, the tooling puts into place a ramp for the bottom edge of the gusset. In the tooling design of FIGS. 20-21, such a ramp is located on the top of the fixturing, although it is used for the bottom edge of the folder. The ramp may be a solid block, or may be two individual ramps along the bottom/left and bottom/right edges of the folder. These two ramps are parallel to the bottom surface of the folder and of the gusset, and are perpendicular to the sides of the folder. Because the pocket assembly has a stair-step shape, the ramps are inclined with respect to the stair-step inclination. In terms of the tooling shown in FIGS. 20-21, the inclination appears as a wedge-shaped vacancy inside the folder, between the ramp plane and a plane connecting the bottom edges of the pockets. Such a wedge opens toward the rear of the tooling. Note that the ramps may have teeth that accommodate the corresponding folds in the gusset.

Once the ramps are in place, a pre-folded gusset is laid across the ramps and down across the lateral sides of the pocket assembly. Note that each gusset envelops the bottom and two lateral sides of the corresponding folder, and is constructed to include the two bends that correspond to the bottom/left and bottom/right edges of the folder.

Once the gusset is placed onto the ramps and onto the sides of the pocket assembly, the tooling clamps the gusset along the bottom and lateral sides of the folder, and attaches the gusset to the pocket assembly. In many cases, the tooling applies glue in appropriate locations, and applies suitable pressure to ensure that the glue sets properly.

Once the gusset is attached to the pocket assembly, the tooling releases the pressure and withdraws from the sides and bottom of the folder. The plates are optionally tilted to be more vertical, and the completed folder may be removed from the parallel plates.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A method for constructing a stair-step file folder, comprising:

providing a group of attached dividers, each divider in the group being generally planar and including two horizontal folds proximate a bottom edge of the divider, the divider area above the folds forming a wall of a pocket, the divider area between the folds extending to an adjacent divider and forming a bottom of the pocket, the divider area below the folds being attached to the adjacent divider, the adjacent divider forming an opposing wall of the pocket;

contacting the group of attached dividers with a plurality of fingers, each finger in the plurality contacting a bottom of a respective pocket;

increasing the separation between the fingers; and tilting the group of attached dividers front-to-back while increasing the separation between the fingers, so that the fingers remain in contact with the bottoms of the pockets as the finger separation is increased.

2. The method of claim 1, further comprising:

increasing the separation between the fingers until the dividers are separated by a predetermined distance; and inserting the group of dividers, all separated by the predetermined distance, into a gusset having folds that repeat with an interval equal to the predetermined distance; and attaching the dividers to the gusset.

3. The method of claim 2, wherein the fingers are equally-spaced along a line;

wherein the fingers are supported by a tool, the tool being rotatable in a plane parallel to a bottom edge of the group of dividers.

4. A method for constructing a stair-step file folder having a plurality of successive adjacent dividers with successively higher bottoms, comprising the steps of:

a. providing a group of attached dividers, each divider in the group being generally planar and including two horizontal folds proximate a bottom edge of the divider, the divider area above the folds forming a wall of a pocket, the divider area between the folds extending to an adjacent divider and forming a bottom of the pocket, the divider area below the folds being attached to the adjacent divider, the adjacent divider forming an opposing wall of the pocket;

b. inserting a plurality of fingers into the pockets defined by the adjacent dividers c. inserting a plurality of fingers into the folds created on the bottom of the dividers;

d. simultaneously titling the folder so that the bottoms of the dividers are oriented in a stair step relation to each other e. affixing a web around two sides and the bottom of the folder so that the stairstep orientation of the folders is maintained by the affixation of the web.

5. The method of claim 4 further including the step of such that the increasing the separation between the fingers; and tilting the group of attached dividers front-to-back while increasing the separation between the fingers, so that the fingers remain in contact with the bottoms of the pockets as the finger separation is increased.

6. The method of claim 4 further including the step of pressing the web into the dividers at their bottom and sides.

7. The method of claim 4 further including pressing a corrugated web into the dividers at their bottoms and side and then removing the folder once the gusset and dividers are bonded into their stair step orientation.

8. A method for constructing a stair-step file folder having a plurality of successive adjacent dividers with successively higher bottoms, comprising the steps of:

a. providing a group of attached dividers, each divider in the group being generally planar and a bottom fold, the divider area above the fold forming a wall of a pocket, the divider area between the fold extending to an adjacent divider and forming a bottom of the pocket, the adjacent divider forming an opposing wall of the pocket;

b. contacting the bottom of pockets c. simultaneously titling the folder while maintaining contact with the bottom so as to splay the bottoms of the pockets with the dividers are oriented in a stair step relation to each other d. affixing a web around two sides and the bottom of the folder so that the stairstep orientation of the pocket bottoms is maintained by the affixation of the web.

9. The method of claim 8 wherein maintaining contact with the bottoms of the pockets is achieved by fixing contact with the bottoms while tilting the rest of the folder.

10. A method for assembling a stair-step folder, comprising:

providing a plurality of identically-sized, planar, generally parallel, generally rectangular dividers having respective top edges, bottom edges and lateral sides, each divider in the plurality being folded proximate its bottom edge toward a front of the folder, each divider in the plurality being attached at its bottom edge to a directly adjacent divider;

inserting the plurality of dividers into a plurality of parallel plates, the dividers having a one-to-one correspondence to the spaces between adjacent plates;

tilting the plurality of parallel plates without changing an angular orientation of a plane that includes the bottom edges of the dividers;

bending the lateral sides of the dividers to form lateral flaps;

placing a ramp adjacent the respective bottom edges of the dividers, the ramp being parallel to a bottom edge of the folder and being angled front-to back with respect to a plane that includes the bottom edges of the dividers;

placing a gusset over the ramp and adjacent to the lateral flaps of the dividers;

clamping the gusset onto the ramp and onto the lateral flaps of the dividers;

attaching the gusset to the lateral flaps of the dividers to form the assembled folder; and unclamping the gusset from the assembled folder.

* * * * *